US008360022B2

(12) United States Patent
Ozawa et al.

(10) Patent No.: US 8,360,022 B2
(45) Date of Patent: Jan. 29, 2013

(54) VALVE TIMING CONTROL APPARATUS

(75) Inventors: Yasuo Ozawa, Kariya (JP); Masaki Kobayashi, Okazaki (JP); Kenji Ikeda, Nagoya (JP); Kazunari Adachi, Chiryu (JP); Mitsuru Uozaki, Obu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/256,883

(22) PCT Filed: Feb. 12, 2010

(86) PCT No.: PCT/JP2010/052075

§ 371 (c)(1),
(2), (4) Date: Sep. 15, 2011

(87) PCT Pub. No.: WO2011/001702

PCT Pub. Date: Jan. 6, 2011

(65) Prior Publication Data

US 2012/0000437 A1 Jan. 5, 2012

(30) Foreign Application Priority Data

Jul. 1, 2009 (JP) ..... 2009-157262

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 5,823,152 A 10/1998 Ushida
5,836,277 A 11/1998 Kira et al.
(Continued)

FOREIGN PATENT DOCUMENTS

JP 11-132015 5/1999
JP 11-210424 8/1999
(Continued)

OTHER PUBLICATIONS

International Search Report (PCT/ISA/210) issued on Mar. 9, 2010, by Japanese Patent Office as the International Searching Authority for International Application No. PCT/JP2010/052075.

(Continued)

*Primary Examiner* — Zelalem Eshete
(74) *Attorney, Agent, or Firm* — Buchanan Ingersoll & Rooney PC

(57) ABSTRACT

Provided is a valve timing control apparatus configured to realize a locked state before an engine is stopped by controlling a restricting mechanism and a locking mechanism while the engine is operating. The apparatus includes a partitioning section provided in a driven-side rotary member for partitioning between an advanced angle chamber and a retarded angle chamber, a restricting member disposed in the driven-side rotary member and capable of projecting/retracting relative to a driving-side rotary member, a restricting recess portion formed in the driving-side rotary member and receiving the restricting member projected therein for restricting a relative rotational phase within a predetermined range, a locking member disposed in the driven-side rotary member and capable of projecting/retracting relative to the driving-side rotary member, a locking recess portion receiving the locking member projected therein for locking the relative rotational phase to a predetermined phase, and a communication passageway capable of feeding fluid releasing the restriction by the restricting member to the locking member and incapable of feeding fluid releasing the locking by the locking member to the restricting member. The restricting member switches over the communication passageway to a communicating state or to a non-communicating state.

12 Claims, 14 Drawing Sheets

U.S. PATENT DOCUMENTS

| | | | | |
|---|---|---|---|---|
| 6,053,139 | A | 4/2000 | Eguchi et al. | |
| 6,739,298 | B2 * | 5/2004 | Kusano et al. | 123/90.17 |
| 2002/0139332 | A1 | 10/2002 | Takenaka | |
| 2010/0050966 | A1 | 3/2010 | Ozawa et al. | |
| 2011/0168114 | A1 | 7/2011 | Kobayashi et al. | |

FOREIGN PATENT DOCUMENTS

| | | | |
|---|---|---|---|
| JP | 11-311107 | A | 11/1999 |
| JP | 2000-002104 | | 1/2000 |
| JP | 2002-357105 | A | 12/2002 |
| JP | 2003-286813 | | 10/2003 |
| JP | 3918971 | B2 | 5/2007 |

OTHER PUBLICATIONS

Written Opinion (PCT/ISA/237) issued on Mar. 9, 2010, by Japanese Patent Office as the International Searching Authority for International Application No. PCT/JP2010/052075.

Notification of Transmittal of Translation of the International Preliminary Report on Patentability (Forms PCT/IB/338 and PCT/IB/373) and the Written Opinion of the International Searching Authority (Form PCT/ISA/237) issued on Feb. 23, 2012, in the corresponding International Application No. PCT/JP2010/052075. (5 pages).

* cited by examiner 60
50
22
87(86)
64
54
54a
64a
53
63
6
5f
5d
5
6c
6f
5e
5c
5b
6b
6e
5a
5g
6g
6d
6a
51
85d(86)
85b
(86)
61
83
85
89
31(3)
88
85a(82)
85c
(82,86)
52b
84(82)
23
52
T
21
62
R
52a
21a (a)

(b)

(a)

(b)

VALVE TIMING CONTROL APPARATUS

TECHNICAL FIELD

The present invention relates to a valve timing control apparatus for controlling a relative rotational phase of a driven-side rotary member relative to a driving-side rotary member which is rotated in synchronism with a crankshaft of an internal combustion engine.

BACKGROUND ART

Conventionally, there is known a valve timing control apparatus including a restricting mechanism provided separately from a locking mechanism for maintaining a relative rotational phase of a driven-side rotary member relative to a driving-side rotary member to a predetermined phase (locking phase), the restricting mechanism consisting of a restricting recess portion formed in the driven-side rotary member and a restricting member provided in the driving-side rotary member and capable of projecting/retracting relative to the restricting recess portion.

For instance, Patent Document 1 discloses a restricting mechanism consisting of an engaging pin 91 (restricting member) and an engaging groove 28 (restricting recess portion). With such arrangement, the locking mechanism can be operated after the relative rotational phase of the driven-side rotary member relative to the driving-side rotary member is restricted within a predetermined range, so that the locked state can be realized more easily.

Further, with the valve timing control apparatus described in Patent Document 1, there is adopted an arrangement that fluid is discharged from the advanced angle chamber and the retarded angle chamber when the relative rotational phase is not at the locking phase at the time of startup of the engine. This arrangement is provided for realizing the locked state during rotation of the engine as a condition that positively allows relative rotation of the driven-side rotary member relative to the driving-side rotary member immediately after engine startup.

PRIOR ART DOCUMENT

Patent Document

Patent Document 1: Japanese Patent No. 3918971

SUMMARY OF THE INVENTION

Object to be Achieved by Invention

However, with the valve timing control apparatus disclosed in Patent Document 1, as fluid is discharged from the advanced angle chamber and the retarded angle chamber immediately after engine startup, there is provided a switching valve 110 dedicated to this purpose. For this reason, there is the risk of inviting deterioration in the readiness of mounting and cost increase of the valve timing control apparatus. Further, if the locked state is to be realized at the time of engine startup, there is the risk of speedy transition to the operating state being not possible. Therefore, there is a need for an arrangement capable of realizing the locked state before the engine is stopped. Moreover, if such locking mechanism configured to provide locking by fluid discharge is operated at the time of engine stop, the fluid discharge can be accompanied by sharp drop in the rotational speed of the driven-side rotary member and the driving-side rotary member, so that reliable locking may not be provided.

In view of the above-described state of the art, the object of the present invention is to provide a valve timing control apparatus which is configured to realize a locked state before the engine is stopped by controlling a restricting mechanism and a locking mechanism while the engine is operating and which also eliminates the need for a dedicated switching valve for controlling the restricting mechanism and the locking mechanism.

Means for Achieving the Object

According to the first characterizing feature of a valve timing control apparatus relating to the present invention, the apparatus comprises:

a driving-side rotary member rotated in synchronism with a crankshaft of an internal combustion engine;

a driven-side rotary member disposed coaxially with the driving-side rotary member and rotated in synchronism with a valve opening/closing cam shaft of the internal combustion engine;

a fluid pressure chamber formed by the driving-side rotary member and the driven-side rotary member;

a partitioning section provided in at least one of the driving-side rotary member and the driven-side rotary member for partitioning the fluid pressure chamber into an advanced angle chamber and a retarded angle chamber;

a restricting member disposed in either one rotary member of the driving-side rotary member and the driven-side rotary member and capable of projecting/retracting relative to the other rotary member of the same;

a restricting recess portion formed in the other rotary member for receiving the restricting member projected therein for restricting a relative rotational phase of the driven-side rotary member relative to the driving-side rotary member within a range from either one of a most advanced angle phase and a most retarded angle phase to a predetermined phase between the most advanced angle phase and the most retarded angle phase;

a locking member disposed in said one rotary member provided with said restricting member and capable of projecting/retracting relative to said other rotary member;

a locking recess portion formed in said other rotary member for receiving the locking member projected therein for locking the relative rotational phase of the driven-side rotary member to the driving-side rotary member to said predetermined phase;

a communication passageway capable of feeding fluid releasing the restriction by the restricting member to the locking member and incapable of feeding fluid releasing the locking by the locking member to the restricting member; and said restricting member switching over said communication passageway to a communicating state or to a non-communicating state.

With the above-described arrangement, e.g. by switching over between an angle advancing control and an angle retarding control, it is possible to realize a state wherein both the restricted state by the restricting member and the locked state by the locking member are released, a further state wherein only the locked state by the locking member is released and a still further state wherein the locked state is provided by the locking member. Next, there will be described an exemplary case in which the releasing of the restriction by the restricting member is effected by means of feeding of fluid from the advanced angle chamber and the releasing of the locked state by the locking member is effected by means of feeding of fluid from the retarded angle chamber.

Since the fluid for releasing the restriction by the restricting member can be fed to the locking member, with execution of the angle advancing control, there can be realized the state wherein both the restricted state by the restricting member and the locked state by the locking member are released. Further, since the fluid for releasing the locked state by the locking member cannot be fed to the restricting member, with execution of the angle retarding control, there can be realized the state wherein only the locked state by the locking member is released. Still further, since the communication passageway is switched over into the non-communication state by the restricting member, when the angle advancing control is effected, the locked state and the lock-released state of the locking member can be realized. Namely, since the above-described respective states can be realized with switchover of the angle advancing control and the angle retarding control, it is possible to realize the locked state during engine operation. Further, even if the realization of the locked state should once fail, it is still possible to attempt the realization of the locked state by repeating execution of the angle advancing/retarding control.

According to the second characterizing feature of the present invention, the apparatus is capable of selectively providing a first state wherein the restriction by the restricting member is released and the locking by the locking member is released and a second state wherein the locking by the locking member is released and the restriction is provided by the restricting member, the first state and the second state both being provided with the communication passageway being set at the communicating state, and a third state wherein the restriction by the restricting member is provided and the locking by the locking member is provided, the third state being provided with the communication passageway being set at the non-communicating state With the above-described arrangement in operation, for instance, the first state in which both the restricting member and the locking member are released is provided in advance with the angle advancing control and there is provided the state which allows desired change of the relative phase between the driving-side rotary member and the driven-side rotary member. Then, from the above condition, by switching over to the angle retarding control, it is possible to shift to the second state in which the feeding of fluid pressure to the restricting member is stopped to bring this restricting member into the restricting state while feeding fluid pressure to the locking member for maintaining the lock-released state thereof. In this, if the relative phase of the driven-side rotary member relative to the driving-side rotary member is located adjacent the locking phase, a subsequent locking operation of the locking member may be facilitated. Then, the control is now switched over to the angle advancing control and the state is shifted to the third state in which the feeding of the fluid pressure to the locking member is stopped to bring the locking member into the locking state. In this way, with switchover of the states of the restricting member and the locking member while the internal combustion engine is being operated, the relative rotational phase between the driving-side rotary member and the driven-side rotary member can be set to the locked state only with the angle advancing/retarding control of the fluid, so that the locked state can be realized in a reliable manner.

According to the third characterizing feature of the present invention, transition from the third state to the second state is effected by feeding fluid to either one of the advanced angle chamber and the retarded angle chamber and the transition from the second state to the first state is effected by feeding fluid to the other of the advanced angle chamber and the retarded angle chamber.

With the above-described construction, with the switchover of fluid feeding to the advanced angle chamber or the retarded angle chamber, the state is shifted from the third state to the first state. Therefore, no special switching valve needs to be provided for releasing the locked state. Hence, the valve timing control apparatus can be advantageous in the respects of the readiness of mounting and cost.

According to the fourth characterizing feature of the present invention, the apparatus further comprises a fluid controlling means that can be switched over to the first state, the second state or the third state, and wherein said fluid controlling means includes:

a restricting member accommodating portion having a first fluid chamber for receiving the fluid for releasing the restriction by the restricting member, said restricting member accommodating portion being formed in said one rotary member for accommodating the restricting member, a locking member accommodating portion having a second fluid chamber for receiving the fluid for releasing the locking of the locking member and a third fluid chamber provided separately from said second fluid chamber for receiving the fluid for retaining the lock-released locking member under this lock-released state, said locking member accommodating portion being formed in said one rotary member for accommodating said locking member, a restriction releasing passageway for establishing communication between one of said advanced angle chamber and said retarded angle chamber and said first fluid chamber, a lock releasing passageway for establishing communication between the other of said advanced angle chamber and said retarded angle chamber and said second fluid chamber; and said communication passageway configured to establish communication between said first fluid chamber and said third fluid chamber;

wherein said fluid controlling means selectively provides said first state by feeding fluid to said first fluid chamber, said communication passageway, said third passageway via said restriction releasing passageway, said fluid controlling means selectively provides said second state by feeding fluid to said second fluid chamber via said lock releasing passageway, and said fluid controlling means selectively provides said third state by feeding fluid to none of said first fluid chamber, said second chamber and said third chamber.

With the above-described arrangement, the fluid controlling means effects its control operations through the fluid fed from either the advanced angle chamber or the retarded angle chamber. Therefore, the switching operations to the first state, the second state or the third state are possible by means of the switching valve provided normally for effecting the advancing/retarding control operations. Therefore, there is no need for newly providing a switching valve for realizing the locked state. Hence, the valve timing control apparatus can be advantageous in the respects of the readiness of mounting and cost.

According to the fifth characterizing feature of the present invention, said restriction releasing passageway includes:

a restricting-time communication passageway capable of establishing communication between either one of the advanced angle chamber and the retarded angle chamber and the first fluid chamber when the restricting member is projected into the restricting recess portion, and a releasing-time communication passageway capable of establishing communication between either one of the advanced angle chamber and the retarded angle chamber and the first fluid chamber when the restricting member is retracted away from the restricting recess portion.

With the above-described construction, a releasing-time communication passageway for feeding fluid to the first fluid chamber when the restricting member is retracted away from the restricting recess portion is provided separately from a restricting-time communication passageway for feeding fluid to the first fluid chamber when the restricting member is projected into the restricting recess portion. Therefore, if the releasing-time communication passageway is provided with a passageway diameter greater than the restricting-time communication passageway and provided also with a higher pressure resistance than the same, the fluid can be speedily fed to the third fluid chamber through the communication passageway. In this way, with use of an arrangement suitable for requirement of each passageway, the controllability is improved.

According to the sixth characterizing feature of the present invention, said restricting-time communication passageway is configured to provide non-communication between one of said advanced angle chamber and said retarded angle chamber and said first fluid chamber when the driving-side rotary member and the driven-side rotary member are located within a preset phase toward one of said most advanced angle phase and said most retarded angle phase from the condition of the driving-side rotary member and the driven-side rotary member being at said predetermined phase, when said restricting member moves within the range from either one of the most advanced angle phase and the most retarded angle phase to said predetermined phase.

With the above-described arrangement, when the restricting member is located within a predetermined range on the predetermined phase side of the restricting recess portion, this restricting member will not be retracted away from the restricting recess portion. Therefore, during execution of a control operation for locking in the vicinity of the predetermined phase, the restriction by the restricting member will not be released inadvertently. As a result, the reliability of locking can be improved.

According to the seventh characterizing feature, there is provided an angle sensor for detecting a rotational angle of said camshaft;

said angle sensor being configured to detect establishment of a relative rotational phase where either one of the advanced angle chamber and the retarded angle chamber is communicated with the first fluid chamber via the restriction releasing passageway; and after continuation of a relative rotational movement at the time of said detection for a predetermined period, the direction of the relative rotational movement is switched over to shift from the second state to the first state.

In case establishment of a relative rotational phase of one of the advanced angle chamber and the retarded angle chamber being communicated with the first fluid chamber via the restriction releasing passageway is determined based upon an angle detected by an angle sensor for detecting a rotational angle of the camshaft, the transition from the second state to the first state can sometimes fail to be realized if an error exists between the detected angle and the actual relative rotational phase. With the above-described arrangement, in case it has been determined the relative rotational phase now needs to be switched over based upon the detected angle from the angle sensor, yet the actual relative rotational phase has not yet reached such phase, the above arrangement is capable of causing the actual relative rotational phase to reach the target phase by continuation of the relative rotational movement for a predetermined period, hence, the reliability of shifting from the second state to the first state can be improved.

According to the eighth characterizing feature of the present invention, the apparatus is configured to effect a retrial control wherein when the restricting member is located at a relative rotational phase where the restricting member can project into the restricting recess portion, the direction of the relative rotational movement is switched over to shift to the second state and thereafter, when the restricting member has moved to a relative rotational movement to outside of the relative rotational phase where the restricting member can project into the restricting recess portion, the direction of the relative rotational movement is first reverted and then switched over after the restricting member has moved to the relative rotational phase where the restricting member can project into the restricting recess portion.

With the above-described arrangement, in case the second state cannot be realized even with switchover of the direction of relative rotational movement to shift to the second state when the restricting member is located at a relative rotational phase where the restricting member can project into the restricting recess portion, a retrial control operation is effected for effecting the shift to the second state after the restricting member is reverted to the relative rotational phase where the restricting member can project into the restricting recess portion. Hence, the reliability of shifting to the second state can be improved.

According to the ninth characterizing feature of the present invention, the relative rotational phase where the direction of the relative rotational movement is switched over at the time of the retrial control is set as a phase that differs by a predetermined distance on the side of said predetermined phase than a relative rotational phase where the direction of the relative rotational movement was switched over immediately before.

For instance, when the timing of switching over the direction of relative rotational movement for shifting to the second state is determined based on a certain detected angle obtained by the angle sensor, if there exists an error between the detected angle and the actual relative rotational phase, it may happen that the second state cannot be reached even with repeated executions of the retrial control. With the above-described arrangement with each execution of the trial control, adjustment is made in the timing of switching over the direction of relative rotational movement. Therefore, the reliability of the shifting to the second state can be further improved.

According to the tenth characterizing feature, there is provided a drain passageway which becomes communicated with the first fluid chamber for discharging to the atmosphere when either one of the advanced angle chamber and the retarded angle chamber is not communicated with the first fluid chamber when the restricting member is moved within the range from one of the most advanced angle phase and the most retarded angle phase to said predetermined phase or when said locking member is under the locking state.

With the above-described arrangement, an amount of fluid present inside the first fluid chamber can be discharged through the drain passageway. Therefore, the restricting member can project into the restricting recess portion speedily, so that the restricted state can be realized speedily.

According to the eleventh characterizing feature of the present invention, said fluid (feeding) controlling means is configured to shift said restricting member and said locking member to the first state, the second state and the third state one after another, when the rotational speed of the internal combustion engine becomes a value lower than a preset value.

In an ordinary operation mode of an internal combustion engine, under a condition of a reduced rotational speed of the internal combustion engine as is the case with an idling operation for example, there is high likelihood of subsequent occurrence of an engine stop. Then, with the above-described arrangement, when the rotational speed of the internal combustion engine becomes a value lower than a preset value, the state is shifted to the third state to lock the locking member. That is, in the event of stop of the internal combustion engine, the driving-side rotary member and the driven-side rotary member are always locked. Therefore, with the apparatus having the above-described arrangement, the next startup operation of the internal combustion engine can be effected speedily and reliably.

According to the twelfth characterizing feature of the present invention, said restricting member and said locking member are respectively provided with an urging member for urging said restricting member or said locking member toward the restricting recess portion or toward the locking recess portion.

With the above-described arrangement, if the restricting member and the locking member are urged respectively toward the restricting recess portion or toward the locking recess portion, the locked state can be maintained without relying on any power or the gravity.

MODE OF EMBODYING THE INVENTION

Figure 1:
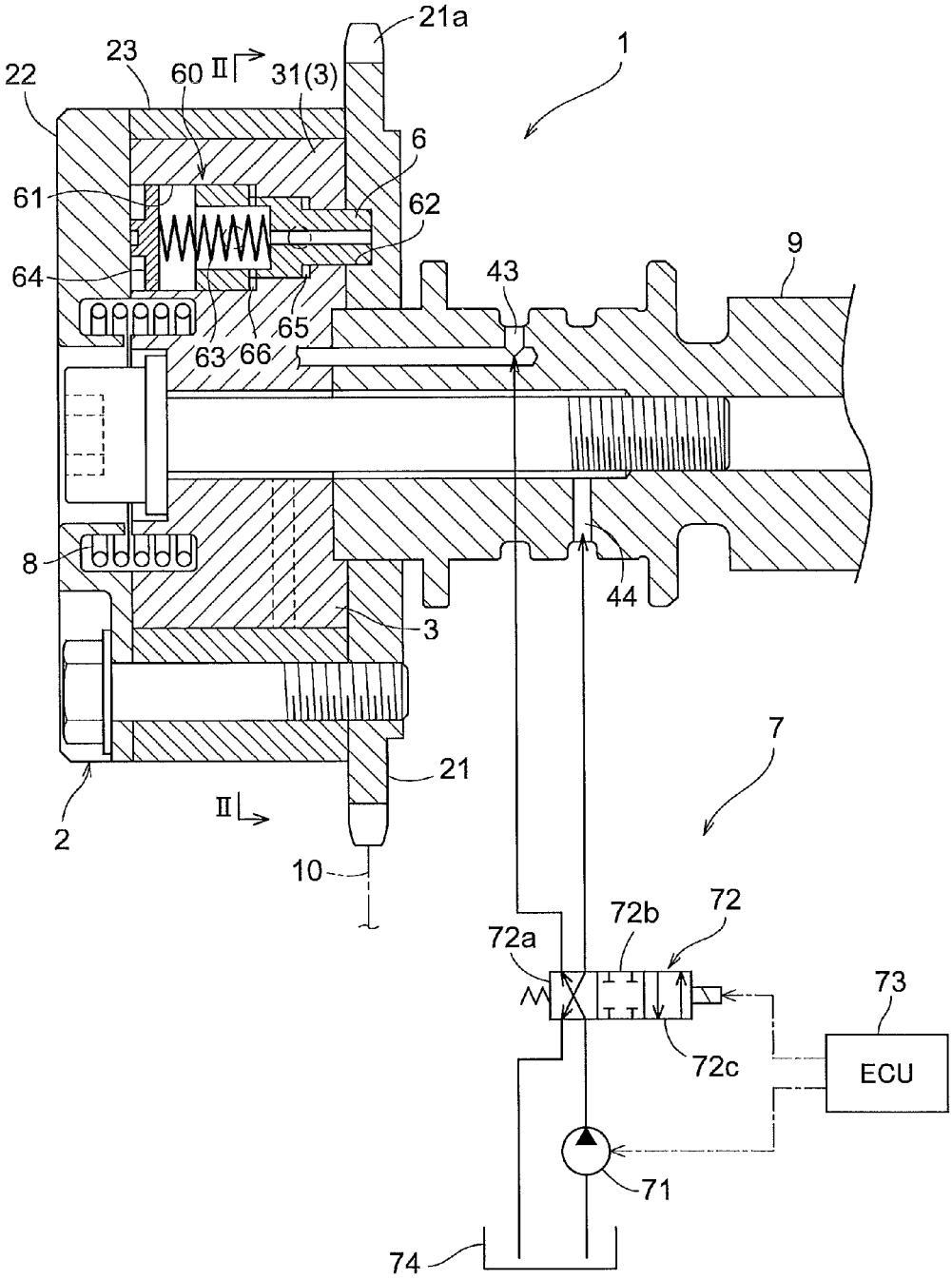
[FIG. 1] is a side view in section showing a general construction of a valve timing control apparatus.

An embodiment of the present invention will be described with reference to FIGS. 1 through 14. Firstly, the general construction of a valve timing control apparatus 1 will be explained with reference to FIGS. 1 and 2.

(General Construction)

The valve timing control apparatus 1 includes an outer rotor 2 as a driving-side rotary member rotated in synchronism with a crankshaft of an unillustrated engine, and an inner rotor 3 disposed coaxially with the outer rotor 2 and acting as a driven-side rotary member rotated in synchronism with a cam shaft 9.

The outer rotor 2 consists essentially of a rear plate 21 attached to the side to which the cam shaft 9 is connected, a front plate 22 attached to the opposite side away from the cam shaft 9 connected side, and a housing 23 clamped between the rear plate 21 and the front plate 22. The inner rotor 3 housed within the outer rotor 2 is assembled integrally with a leading end portion of the cam shaft 9 and is rotatable relative to the outer rotor 2 for a predetermined range.

Figure 2:
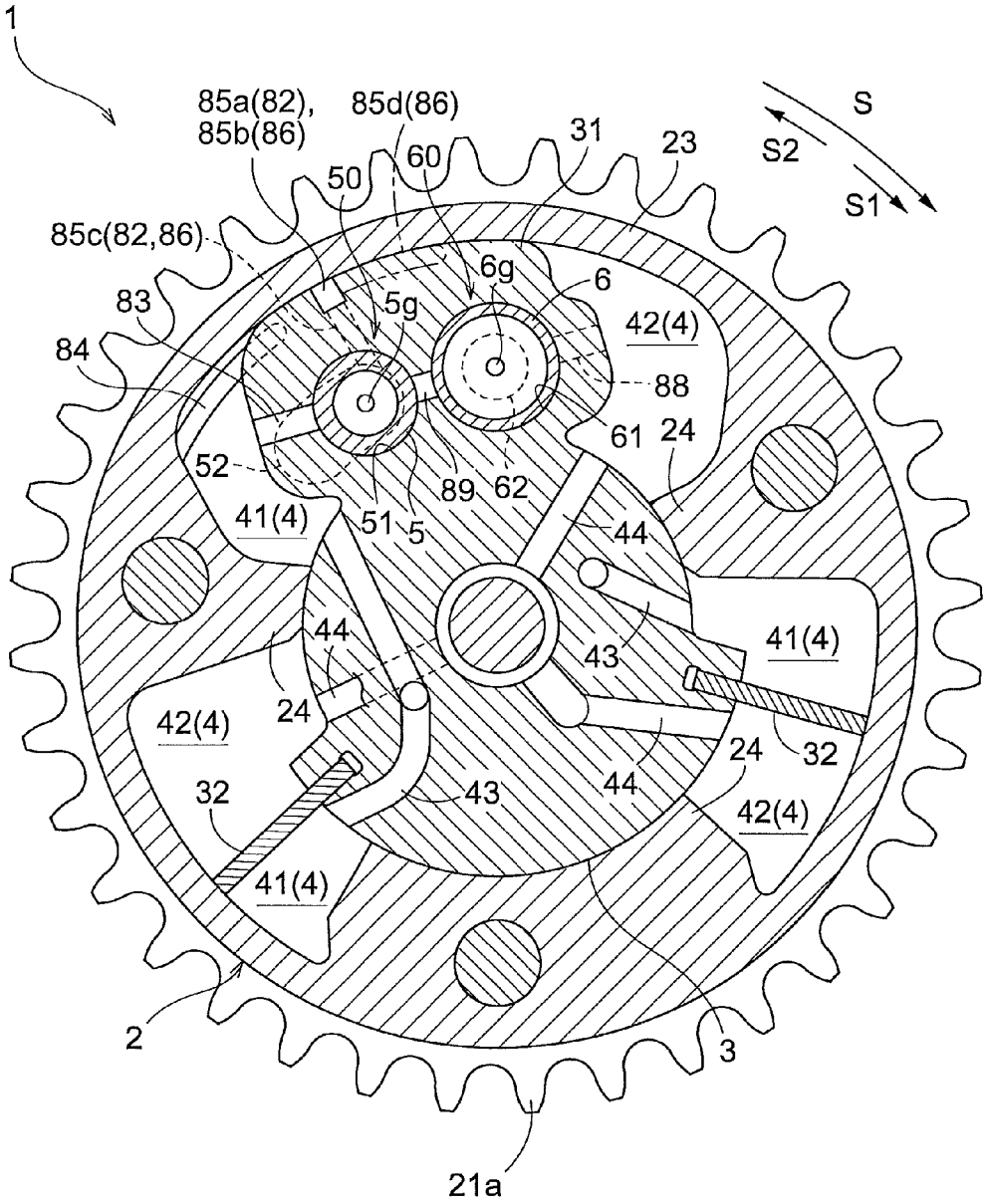
[FIG. 2] is a section taken along II-II in FIG. 1.

When the crankshaft 9 is driven to rotate, this rotational drive force is transmitted via a force transmission member 10 to a sprocket portion 21*a* of the rear plate 21, whereby the outer rotor 2 is driven to rotate in the direction S shown in FIG. 2. In association with this rotational drive of the outer rotor 2, the inner rotor 3 is driven to rotate along the direction S to rotate the cam shaft 9.

The housing 23 of the outer rotor 2 forms a plurality of projecting portions 24 spaced apart from each other along the direction S and projecting radially inward. Each projecting portion 24 and the inner rotor 3 cooperate to form a fluid pressure chamber 4. In this embodiment, there are provided such fluid pressure chambers 4 at three positions. However, the invention is not limited thereto.

Each fluid pressure chamber 4 is partitioned into two parts, namely, into an advanced angle chamber 41 and a retarded angle chamber 42, by means of a partitioning portion 31 forming a part of the inner rotor 3 or a vane 32 attached to the inner rotor 3. The partitioning portion 31 forms a restricting member accommodating portion 51 and a locking member accommodating portion 61, the former accommodating a restricting member 5 and the latter accommodating a locking member 6, thus constituting a restricting mechanism 50 and a locking mechanism 60, respectively. These arrangements will be described later.

The inner rotor 3 defines an advanced angle passageway 43 which is communicated to the advanced angle chamber 41. The inner rotor 3 further defines a retarded angle passageway 44 which is communicated to the retarded angle chamber 42. The advanced angle passageway 43 and the retarded angle passageway 44 respectively feed/discharge fluid to/from the advanced angle chamber 41 and the retarded angle chamber 42 via a fluid feeding/discharging mechanism 7, thereby to apply a fluid pressure to the partitioning portion 31 or the vane 32. With this, the relative rotational phase of the inner rotor 3 relative to the outer rotor 2 is displaced in an angle advancing direction S1 or an angle retarding direction S2 shown in FIG. 2 or maintained at a desired phase. Incidentally, as the fluid, engine oil is generally employed.

The range over which the outer rotor 2 and the inner rotor 3 are rotationally movable relative to each other corresponds to the range over which the partitioning portion 31 or the vane 32 is displaceable within the interior of the fluid pressure chamber 4. The most advanced angle phase is the condition of the capacity of the advanced angle chamber 41 being at its maximum. The most retarded angle phase is the condition of the capacity of the retarded angle chamber 42 being at its maximum. That is, the relative rotational phase can be displaced between the most advanced angle phase and the most retarded angle phase.

Between the inner rotor 3 and the front plate 22, there is mounted a torsion spring 8. The inner rotor 3 and the outer rotor 2 are urged by this torsion spring 8 to cause the relative rotational phase therebetween to be displaced in the angle advancing direction S1.

Next, the construction of the fluid feeding/discharging mechanism 7 will be described. This fluid feeding/discharging mechanism 7 includes a pump 71 driven by the engine to feed fluid, a passageway switching valve 72 for controlling feeding/discharging of the fluid to/from the advanced angle passageway 43 and the retarded angle passageway 44, and a reservoir portion 74 for reserving an amount of fluid therein.

The passageway switching valve 72 is operated under control by an ECU 3 (engine control unit). The passageway switching valve 72 has a first position 72*a* for effecting an angle advancing control by allowing feeding of fluid to the advanced angle passageway 43 and allowing also discharging of fluid from the retarded angle passageway 44, a second position 72*b* for effecting a position maintaining control by inhibiting feeding/discharging of fluid to/from the advanced angle passageway 43 and the retarded angle passageway 44, and a third position 72*c* for effecting an angle retarding control by allowing discharging of fluid from the advanced angle passageway 43 and allowing also feeding of fluid to the retarded angle passageway 44. The passageway switching valve 72 employed in this embodiment is configured to effect the angle advancing control at the first position 72*a* in the case of absence of any control signal from the ECU 73.

(Restricting Mechanism)

Figure 3:
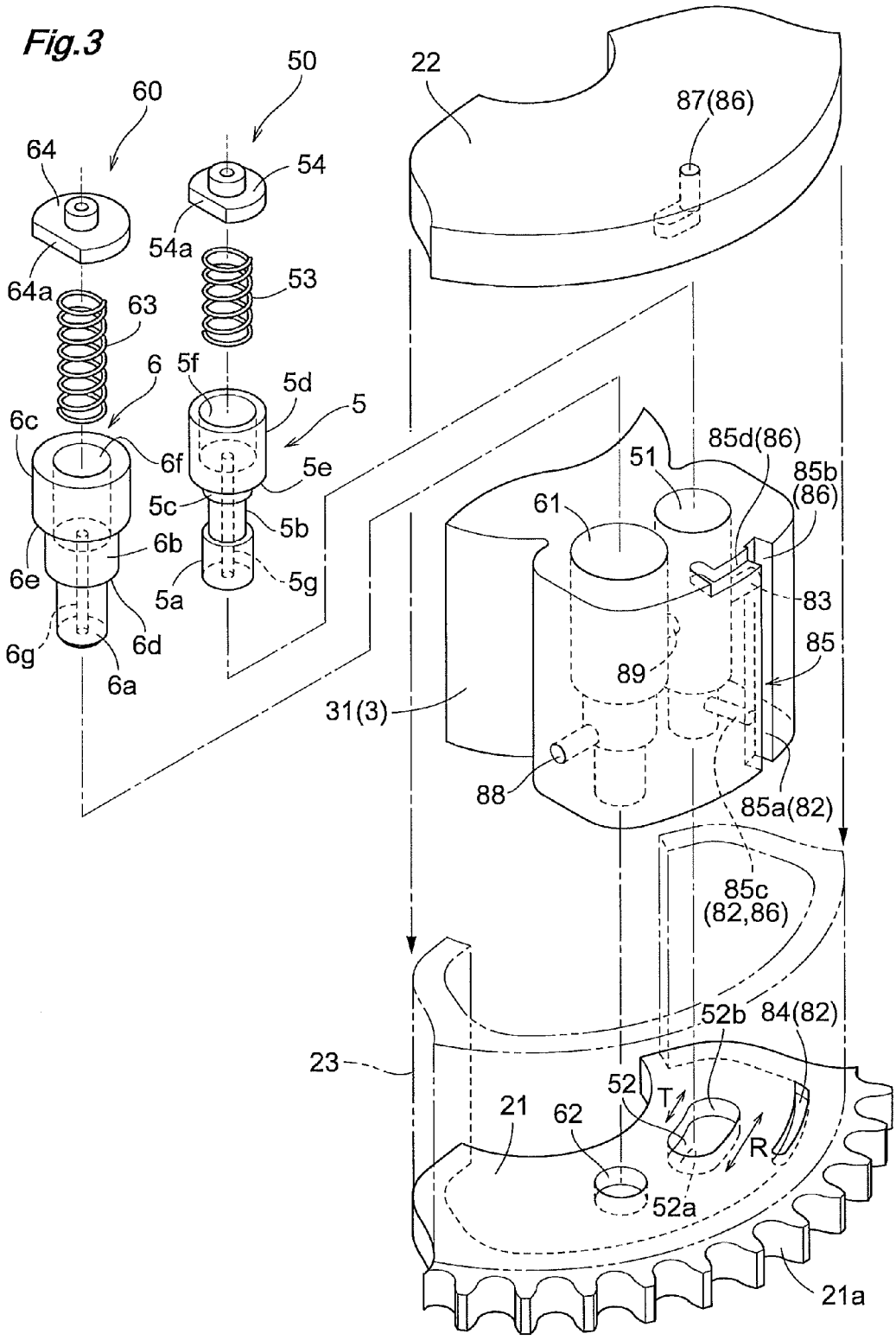
[FIG. 3] is an exploded view showing the constructions of a restricting mechanism and a locking mechanism.
Figure 4:
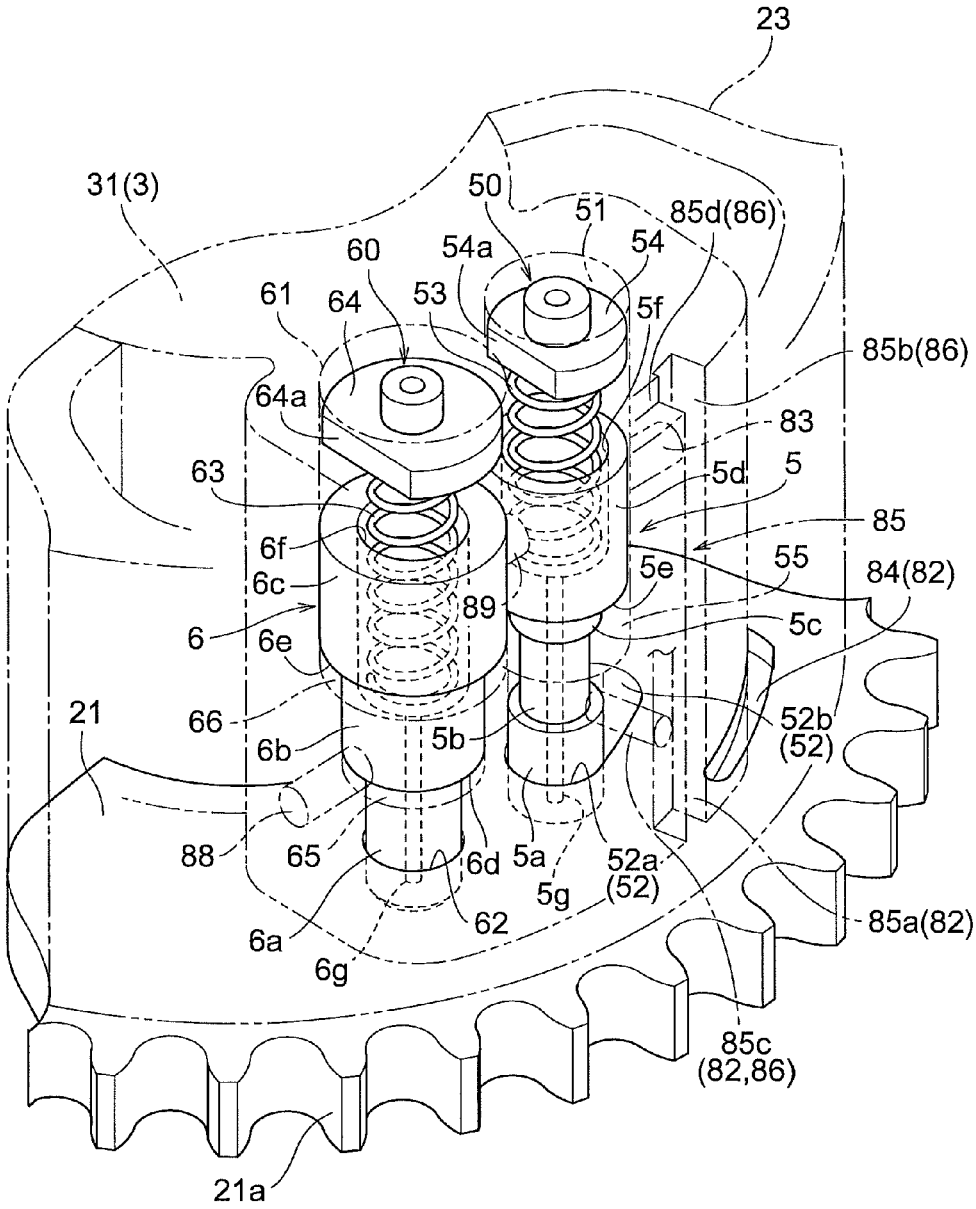
[FIG. 4] is a perspective view showing the constructions of the restricting mechanism and the locking mechanism.

The construction of the restricting mechanism 50 for restricting the relative rotational phase within the range from the most retarded angle phase to an intermediate locking phase (this range will be referred to as a "restricted range R" hereinafter) with reference to FIGS. 3 and 4. The language "intermediate locking phase" refers to a relative rotational phase where the phase is locked by the locking mechanism 60 to be detailed later.

The restricting mechanism 50 consists essentially of a restricting member 5 in the form of a cylindrical member having stepped portions, the restricting member accommodating portion 51 accommodating the restricting member 5, and a restricting recess portion 52 formed like a rectangular bore in the surface of the rear plate 21 so as to allow projection of the restricting member 5 therein.

The restricting member 5 has a shape of four-layered stacked assembly of cylinders of differing diameters. In this four-layered cylindrical member, the respective portions from the side of the rear plate 21 are referred to as a first stepped portion 5*a*, a second stepped portion 5*b*, a third stepped portion 5*c* and a four stepped portion 5*d*, respectively. The second stepped portion 5*b* has a smaller diameter than the first stepped portion 5*a*. Then, toward the side of the front plate 22, the second stepped portion 5*b*, the third stepped portion 5*c* and the fourth stepped portion 5*d* have progressively increased diameters in this order. The third stepped portion 5*c* is provided for reducing the capacity of the first fluid chamber 55, thereby to improve the performance of the restricting member 5 when fluid is fed to the first fluid chamber 55.

The first stepped portion 5*a* is configured to be projectable into the restricting recess portion 52. When the first stepped portion 5*a* is projecting into the restricting recess portion 52, the relative rotational phase is restricted within the restricted range R. The fourth stepped portion 5*d* defines a cylindrical recess portion 5*f*, in which a spring 53 is accommodated. Further, in order to alleviate fluid resistance encountered by the restricting member 5 along the urging direction thereby to improve its operability, the restricting member 5 defines a through hole 5*g* at the center thereof.

Between the restricting member 5 and the front plate 22, there is provided a plug member 54. And, the spring 53 is mounted between this plug member 54 and the bottom face of the recess portion 5*f*. The plug member 54 includes a cutaway portion 54*a* which is provided for allowing discharge of fluid to the outside of the valve timing control apparatus 1 via an unillustrated discharging passageway when the restricting member 5 moves toward the front plate 22, thereby to contribute to further improvement of the operability of the restricting member 5.

The restricting member accommodating portion 51 is formed in the inner rotor 3 along the direction of the rotational axis ("rotational axis" hereinafter) of the cam shaft 9 and extends through the inner rotor 3 from the side of the front plate 22 to the side of the rear plate 21. The restricting member accommodating portion 51 has a shape of e.g. stacked combination of two cylindrical spaces differing in the diameters thereof and allowing movement of the restricting member 5 therein.

The restricting recess portion 52 has an arcuate shape centering about the rotational axis. And, its position in the radial direction is slightly offset from a locking recess portion 62 to be described later. Further, this restricting recess portion 52 is configured such that when the restricting member 5 is under contact with a first end portion 52*a* thereof, the relative rotational phase is set to the intermediate locking phase and also that when the restricting member 5 is under contact with a second end portion 52*b* thereof, the relative rotational phase is set to the most retarded angle phase. That is, the restricting recess portion 52 corresponds to the restricted range R.

The restricting member 5 is accommodated within the restricting member accommodating portion 51 and also is constantly urged by the spring 53 toward the rear plate 21. When the first stepped portion 5*a* of the restricting member 5 projects into the restricting recess portion 52, the relative rotational phase is restricted within the restricted range R, thus providing a "restricted state". When the first stepped portion 5*a* is retracted away from the restricting recess portion 52 against the urging force of the spring 53, the restricted state is released, thus providing "a restriction released state".

When the restricting member 5 is accommodated within the restricting member accommodating portion 51, these restricting member 5 and the restricting member accommodating portion 51 together form a first fluid chamber 55. In operation, when fluid is fed to the first fluid chamber 55 and its fluid pressure is applied to a first pressure receiving face 5*e*, the restricting member 5 moves toward the front plate 22 against the urging force of the spring 53, thus realizing a restriction released state. The arrangement of the fluid passageway for feeding/discharging the fluid to/from the first fluid chamber 55 will be described in details later herein.

(Locking Mechanism)

The construction of the locking mechanism 60 for locking the relative rotational phase to an intermediate locked state will be described next with reference to FIGS. 3 and 4. The locking mechanism 60 consists essentially of the locking member 6 in the form of a cylindrical member having stepped portions, the locking member accommodating portion 61 accommodating the locking member 6, and a locking recess portion 62 formed like a circular bore in the surface of the rear plate 21 so as to allow projection of the locking member 6 therein.

The locking member 6 has a shape of three-layered stacked assembly of cylinders of differing diameters. In this three-layered cylindrical member, the respective portions from the side of the rear plate 21 are referred to as a first stepped portion 6*a*, a second stepped portion 6*b*, and a third stepped portion 6*c*, respectively. The first stepped portion 6*a*, the second stepped portion 6*b*, and the third stepped portion 6*c* have progressively increased diameters in this order.

The first stepped portion 6*a* is configured to be projectable into the locking recess portion 62. When the first stepped portion 6*a* is projecting into the locking recess portion 62, the relative rotational phase is locked to the intermediate locked state. From the third stepped portion 3*c* to a part of the second stepped portion 6*b*, there is formed a cylindrical recess portion 6*f*, in which a spring 63 is accommodated. Further, in order to alleviate fluid resistance encountered by the locking member 6 along the urging direction thereby to improve its operability, the locking member 6 defines a through hole 6*g* at the center thereof.

Between the locking member 6 and the front plate 22, there is provided a plug member 64. And, the spring 63 is mounted between this plug member 64 and the bottom face of the recess portion 6*f*. The plug member 64 includes a cutaway portion 64*a* which is provided for allowing discharge of fluid to the outside of the valve timing control apparatus 1 via an unillustrated discharging passageway when the locking member 6 moves toward the front plate 22, thereby to contribute to further improvement of the operability of the locking member 6.

The locking member accommodating portion 61 is formed in the inner rotor 3 along the direction of the rotational axis and extends through the inner rotor 3 from the side of the front plate 22 to the side of the rear plate 21. The locking member accommodating portion 61 has a shape of stacked combination of three cylindrical spaces differing in the diameters thereof and allowing movement of the locking member 6 therein.

The locking member 6 is accommodated within the locking member accommodating portion 61 and also is constantly urged by the spring 63 toward the rear plate 21. When the first stepped portion 6*a* of the locking member 6 projects into the locking recess portion 62, the relative rotational phase is restricted to the intermediate locking phase, thus providing a "locked state". When the first stepped portion 6*a* is retracted away from the locking recess portion 62 against the urging force of the spring 63, the locked state is released, thus providing "a lock released state".

When the locking member 6 is accommodated within the locking member accommodating portion 61, these locking member 6 and the locking member accommodating portion 61 together form a second fluid chamber 65 and a third fluid chamber 66. In operation, when fluid is fed to the second fluid chamber 65 and its fluid pressure is applied to a second pressure receiving face 6*d*, the locking member 6 moves toward the front plate 22 against the urging force of the spring 63, thus realizing a lock released state. When fluid is fed to the third fluid chamber 66 and its fluid pressure is applied to a third pressure receiving face 6*e*, the lock released state of the locking member 6 is maintained. The arrangement of the fluid passageway for feeding/discharging the fluid to/from the second fluid chamber 65 and the third fluid chamber 66 will be described in details later herein.

Next, a restriction releasing passageway, a drain passageway, a lock releasing passageway and a communication passageway will be described with reference to FIGS. 3 through 5.

(Restriction Releasing Passageway)

The restriction releasing passageway for realizing the restriction released state includes a restricting-time communication passageway 82 and a releasing-time communication passageway 83. The restricting-time communication passageway 82 consists of a rear plate passageway 84, a first through passageway 85*a* and a feeding passageway 85*c* to be describe later, and is configured as a passageway to feed fluid to the first fluid chamber 55 for releasing the restricted state. And, the releasing-time communication passageway 83 is a passageway configured to feed fluid to the first fluid chamber 55 for maintaining the restriction released state when the restricting member 5 is retracted away from the restriction recess portion 52.

The rear plate passageway 84 is a groove-like passageway formed in the face of the rear plate 21 on the side of the inner rotor 3 and this passageway is communicated with the advanced angle chamber 41. The rear plate passageway 84 is configured to be communicable with a first through passageway 85*a* forming a part of the rotor passageway 85 only when the restricting member 5 is located within a predetermined angle advancing side range (this will be referred to as a "restriction releasing possible range T" hereinafter) in the restricted range R. Incidentally, the presence of the restricting member 5 within the restriction releasing possible range T means presence of the first stepped portion 5*a* completely within the range of the restriction releasing possible range T.

The rotor passageway 85 is a passageway formed in the inner rotor 3 and consists of a first through passageway 85*a*, a second through passageway 85*b*, a feeding passageway 85*c* and a discharging passageway 85*d*. The first through passageway 85*a* and the second through passageway 85*b* are formed continuously linearly along the rotational axis direction in the radially outer side face of the inner rotor 3. The terminal end of the first through passageway 85*a* on the side of the rear plate 21 is configured to be communicated to the rear plate passageway 84 when the restricting member 5 is located within the restriction releasing possible range T. Further, the terminal end of the second through passageway 85*b* on the side of the front plate 22 is connected with the discharging passageway 85*d*. The feeding passageway 85*c* is branched from the border portion between the first through passageway 85*a* and the second through passageway 85*b* and is communicated to the first fluid chamber 55. The discharging passageway 85*d* is formed in a letter-L shape in its plan view in the face of the inner rotor 3 on the side of the front plate 22. And, this discharging passageway 85*d* is configured to be communicated to a discharge hole 87 to be described later only when the restricting member 5 is located within a predetermined angle advanced side range beyond the restriction releasing possible range T.

As described above, the restricting-time communication passageway 82 consists of the rear plate passageway 84, the first through passageway 85*a* and the feeding passageway 85*c*. Therefore, when the restricting member 5 is located within the restriction releasing possible range T, in response to establishment of communication between the rear plate passageway 84 and the first through passageway 85*a*, the restricting-time communication passageway 82 becomes communicated to the first fluid chamber 55 to feed fluid thereto and applies its fluid pressure to the first pressure receiving face 5*e*, thus releasing the restricted state.

The releasing-time communication passageway 83 is a tubular passageway formed within the inner rotor 3 and is communicated with the advanced angle chamber 41. When the restricting member 5 is retracted away from the restricting recess portion 52 thereby to realize the restriction released state, the releasing-time communication passageway 83 is communicated to the first fluid chamber 55 to feed fluid from the advanced angle chamber 41, thereby to apply its fluid pressure to the first pressure receiving face 5*e*, thus maintaining the restriction released state.

Incidentally, when the restricting member 5 is moved toward the front plate 2 against the urging force of the spring 53, the communication of the feeding passageway 85*c* to the first fluid chamber 55 is blocked by the first stepped portion 5*a* at the timing of establishment of communication between the releasing-time communication passageway 83 and the first fluid chamber 55. More particularly, an arrangement is provided such that the passageway for feeding fluid to the first fluid chamber 55 may be selected between the restricting-time communication passageway 82 and the releasing-time communication passageway 83. With this arrangement, when it is desired to discharge fluid from the first fluid chamber 55, it is possible to stop feeding of fluid form the releasing-time communication passageway 83 while allowing discharge of fluid from the first fluid chamber 55 via the feeding passageway 85*c* (a part of a drain oil passageway 86 to be described later).

Strictly speaking, however, the arrangement is such that fluid is fed to the first fluid chamber 55 from both the restricting-time communication passageway 82 and the releasing-time communication passageway 83 at the time of switchover between the restricting-time communication passageway 82 and the releasing-time communication passageway 83. The reason for this is as follows. If there should occur a situation where neither the restricting-time communication passageway 82 nor the releasing-time communication passageway 83 is connected with the first fluid chamber 55 at the time of switchover between the restricting-time communication passageway 82 and the releasing-time communication passageway 83, the first fluid chamber 55 would be temporarily rendered into a sealed state, thus impairing the smoothness of the restricting/releasing operation of the restricting member 5. The above arrangement purports to avoid such situation.

(Drain Passageway)

The drain passageway 86 is a passageway for speedily discharging fluid present inside the first fluid chamber 55 which may otherwise provide resistance against movement of the restricting member 5, when the restricting member 5 projects into the restricting recess portion 52. The drain passageway 86 consists of a feeding passageway 85*c*, a second through passageway 85*b*, a discharging passageway 85*d* and the discharge hole 87. The discharge hole 87 is formed to extend through the front plate 22 along the rotational axis direction.

The drain passageway 86 is configured to be communicated only when the restricting member 5 is located with the predetermined angle advancing side beyond the restriction releasing possible range T and not to be communicated when the restricting member 5 is located within the restriction releasing possible range T. This arrangement prevents inadvertent discharge of the fluid fed from the advanced angle chamber 41 directly through this drain passageway 86, when communication is established between the rear plate communication passageway 84 and the first through passageway 85*a*.

(Lock Releasing Passageway)

The lock releasing passageway 88 is a tubular passageway formed inside the inner rotor 3 and is communicated to the retarded angle chamber 42. This lock releasing passageway 88 is a passageway configured to feed fluid from the retarded angle chamber 42 to the second fluid chamber 65 to apply its fluid pressure to the second pressure receiving face 6*d*, thus causing the locking member 6 to retract away from the lock recess portion 62.

(Communicating Passageway)

The communicating passageway 89 is a tubular passageway formed inside the inner rotor 3 and is configured to establish communication between the first fluid chamber 55 and the third fluid chamber 66 under the restriction released state and when the locking member 6 has moved by a certain amount toward the front plate 22. Upon establishments of communication among the releasing-time communication passageway 83, the first fluid chamber 55, the communicating passageway 89 and the third fluid chamber 66, the fluid fed from the advanced angle chamber 41 to the first fluid chamber 55 is fed also to the third fluid chamber 66, so that the restriction released state and the lock released state can be maintained.

(Operations at Times of Lock Releasing and Restriction Releasing)

Next, a procedure for releasing the locked state with using the restricting mechanism 50, the locking mechanism 60 and the respective passageways described above will be explained with reference to FIGS. 5 through 8.

Figure 5A:
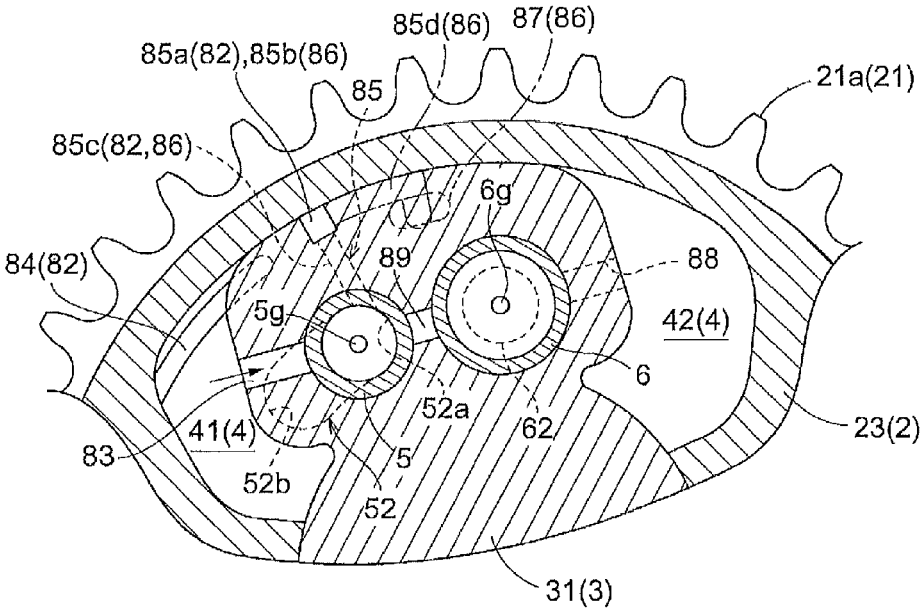
[FIG. 5A] is a plan view and [FIG. 5B] is a section view, illustrating conditions of the restricting mechanism and the locking mechanism at the time of startup of the engine.
Figure 5B:
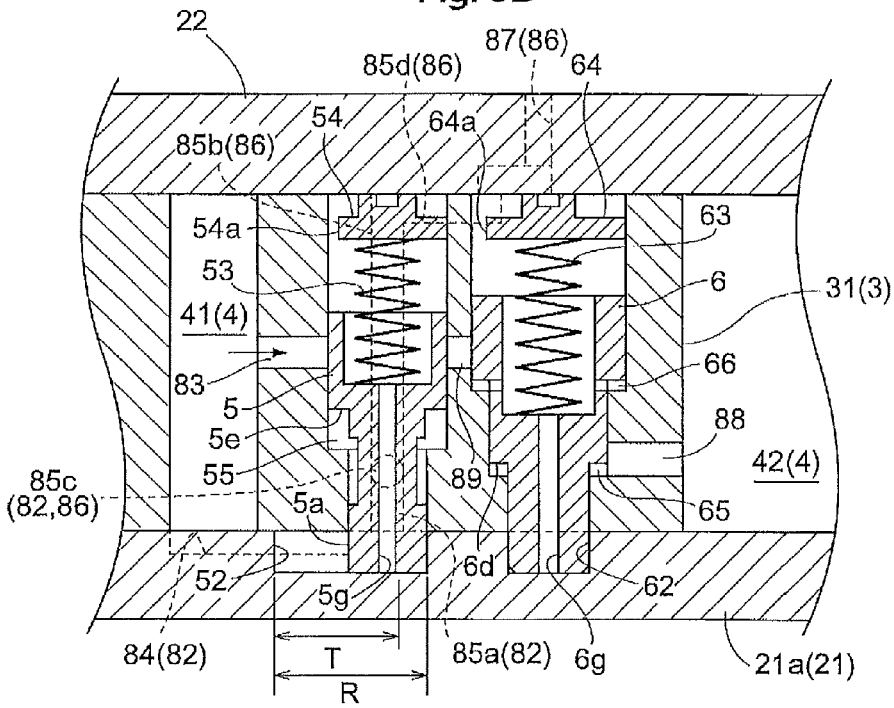

The condition at the time of startup of the engine is shown in FIGS. 5A and 5B. At the time of engine startup, the passageway switching valve 72 is located at the first position 72*a*. Hence, an angle advancing control is effected. However, as the restricting member 5 is located outside the restriction releasing possible range T, no fluid is fed from the restricting-time communication passageway 82 to the first fluid chamber 55. Also, since the releasing-time communication passageway 83 is not communicated to the first fluid chamber 55, either, no fluid is fed to the first fluid chamber 55. Therefore, the locked state is maintained.

Figure 6:
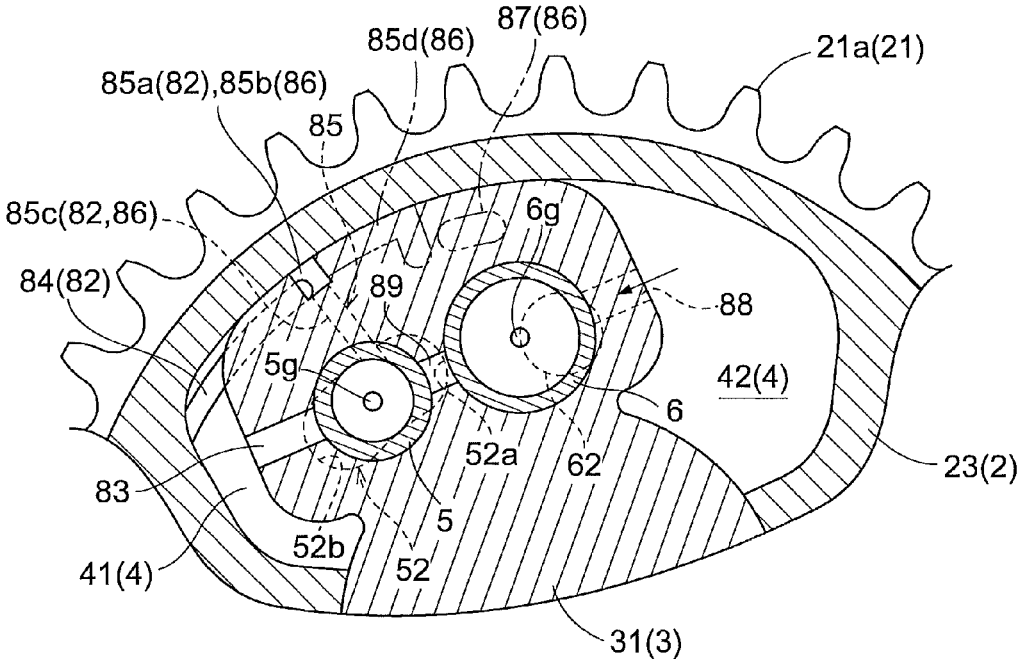
[FIG. 6] are (*a*) a plan view and (*b*) a section view, illustrating conditions of the restricting mechanism and the locking mechanism when a locked state is to be released.
Figure 6:
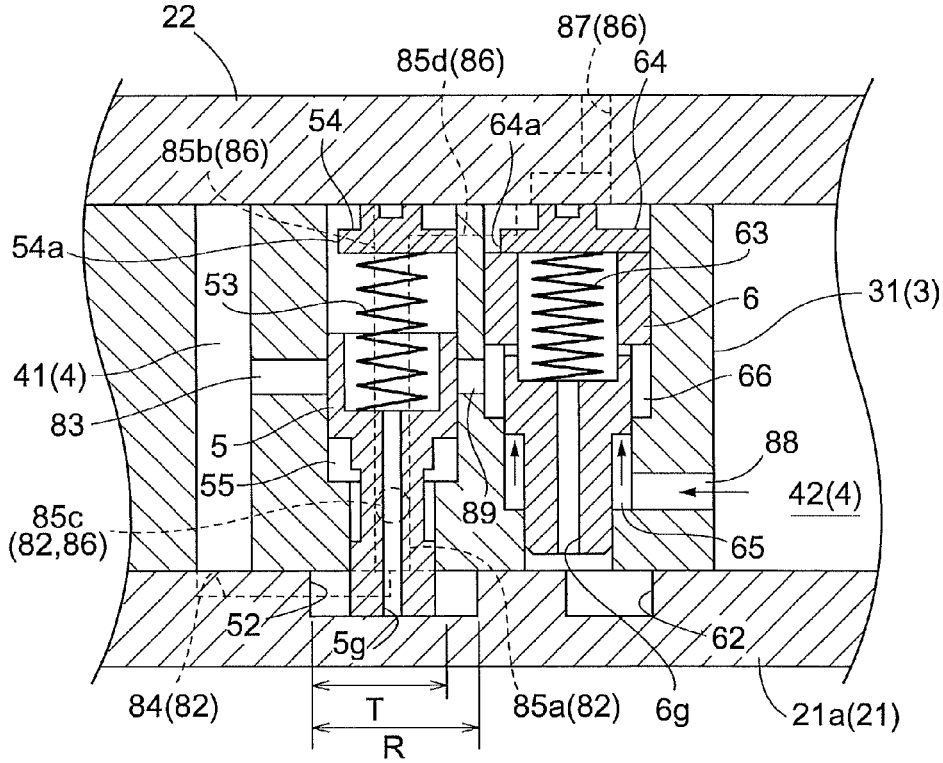

After the engine startup, firstly, in order to release the locked state, the control is switched over to the angle retarding control. This condition is illustrated in FIG. 6. Under this condition, fluid is fed via the lock releasing passageway 88 from the retarded angle chamber 42 to the second fluid chamber 65, whereby the locking member 6 is retracted away from the locking recess portion 62, thus releasing the locked state. Upon release of the locked state, the restricting member 6 will move in the angle retarding direction within the restricting recess portion 52.

Figure 7:
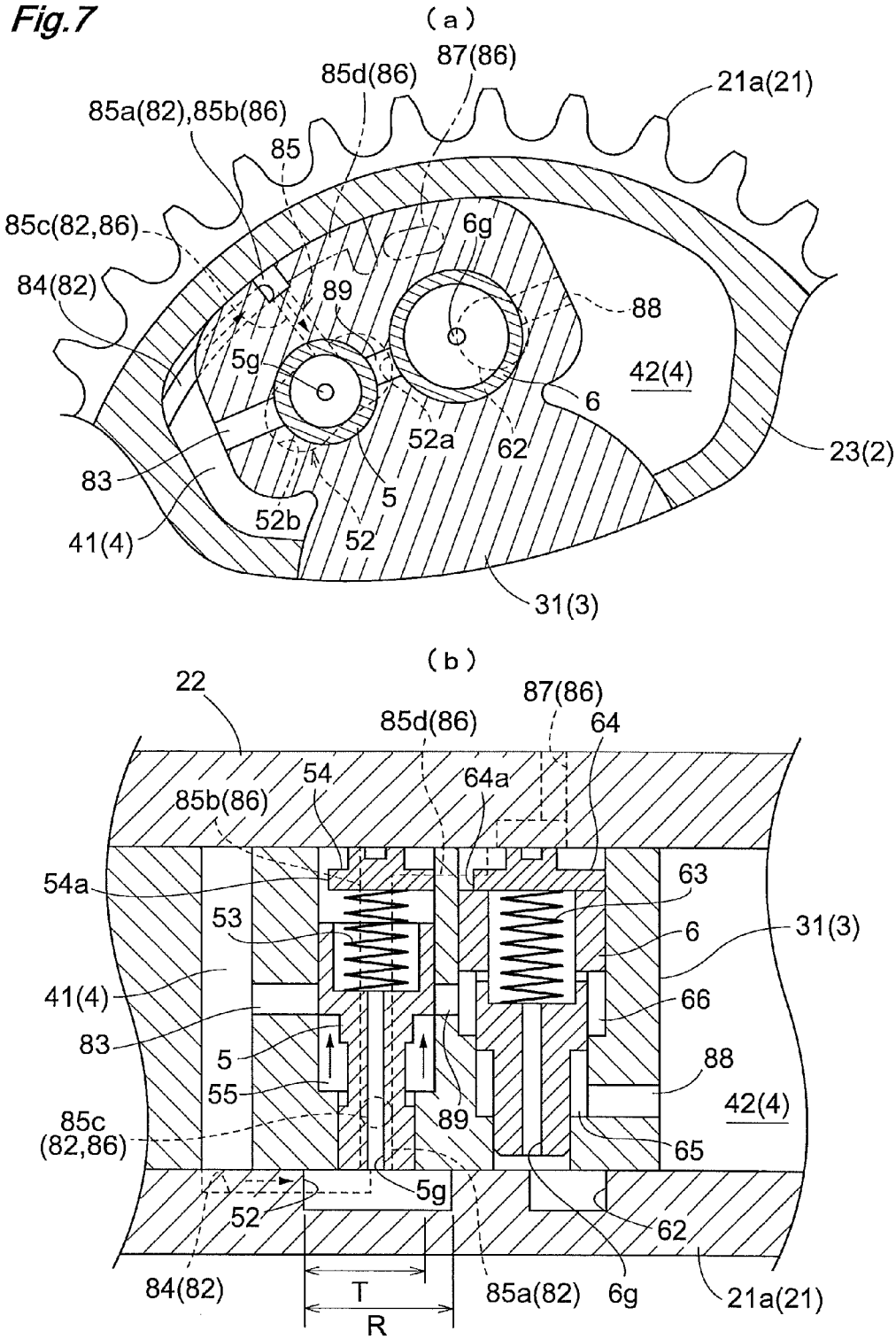
[FIG. 7] are (*a*) a plan view and (*b*) a section view, illustrating conditions of the restricting mechanism and the locking mechanism when a restricted state is to be released.

An angle sensor is provided for detecting a rotational angle of the unillustrated cam shaft 9. Then, when this sensor has detected that the restricting member 6 has reached the relative rotational phase wherein this restricting member 6 is located within the restriction release possible range T, the ECU 73 switches the control over to the angle advancing control. This condition is illustrated in FIG. 7. As communication has been established between the rear plate passageway 84 and the first through passageway 85*a*, fluid is fed from the restricting-time communication passageway 82 to the first fluid chamber 55. In response to this, the restricting member 5 is retracted away from the restricting recess portion 52, thus releasing the restricted state.

If an error exists between the angle detected by the above-described sensor and the actual relative rotational phase, it may happen that the restricting member 6 has not actually reached the restriction releasing possible range T in spite of detection by the angle sensor of the restricting member 6 being located at a relative rotational phase within the restriction releasing possible range T. In such case, even if the control is switched over to the angle advancing control, due to no communication between the restricting-time communication passageway 82 and the first fluid chamber 55, no fluid will be fed to the first fluid chamber 55, thus being unable to release the restricted state.

As a solution to such problem as above, in the instant embodiment, the control is not switched over to the angle advancing control immediately after detection by the angle sensor of the restricting member 6 being located at a relative rotational phase within the restriction releasing possible range T. Rather, an arrangement is made such that by continuing the angle retarding control for a predetermined period after the detection, the restricting member 6 may be located within the restriction releasing possible range T reliably. With adoption of this arrangement, the restricted state can be released in a reliable manner. Incidentally, the sensor for detecting the relative rotational phase is not limited to the angle sensor for detecting the rotational angle of the camshaft. Any other sensor can be employed also.

Figure 8:
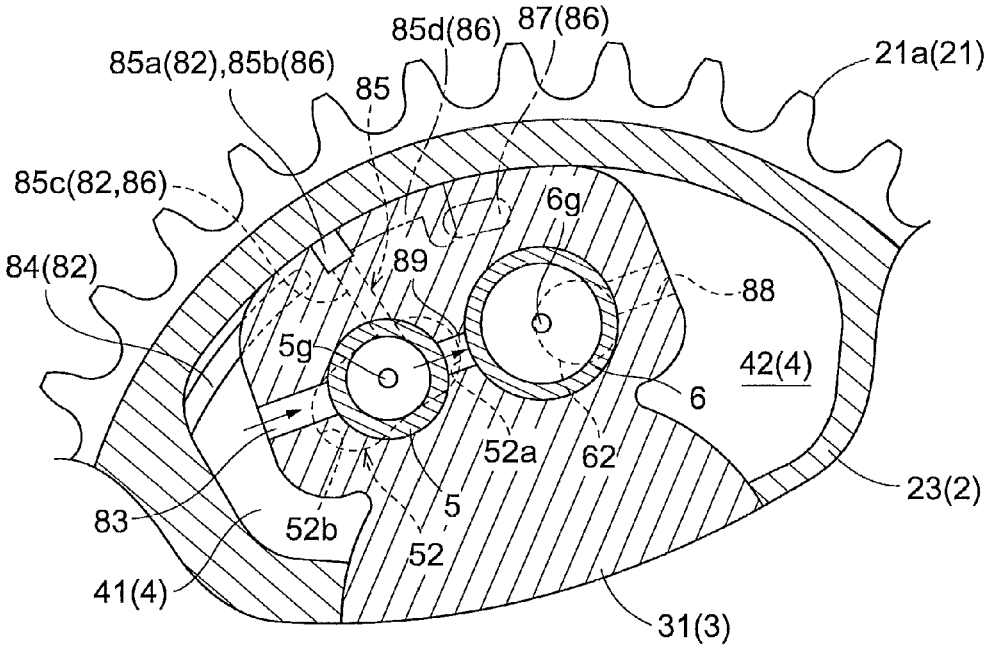
[FIG. 8] are (*a*) a plan view and (*b*) a section view, illustrating conditions of the restricting mechanism and the locking mechanism when a restriction released state and a locking released state are to be maintained.
Figure 8:
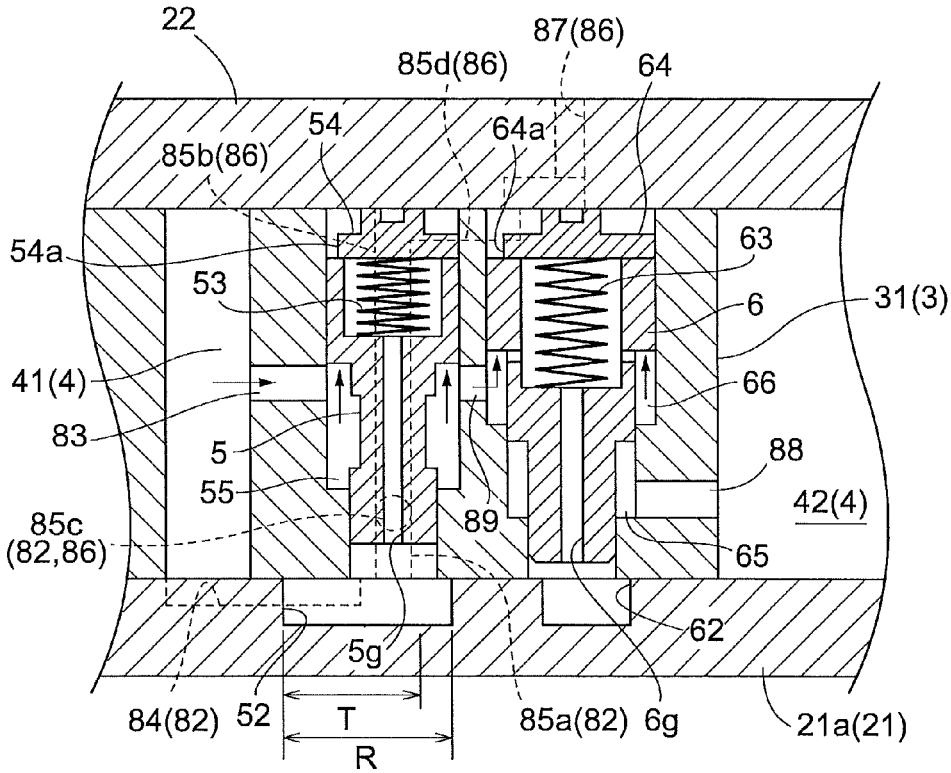

FIG. 8 shows a condition wherein the restriction released state and the lock released state are maintained by the angle advancing control. Under this condition, the first fluid chamber 55 and the third fluid chamber 66 are communicated to each other via the communication passageway 89. Hence, the fluid fed from the advanced angle chamber 41 to the first fluid chamber 55 will be fed also to the third fluid chamber. As a result, the restriction released state and the lock released state are maintained.

(Operations Under Normal Driving Condition)

Next, operations subsequent to establishment of a normal driving condition after realization of the restriction released state and the lock released state by the above-described procedure will be explained with reference to FIG. 9 and FIG. 10.

Figure 9:
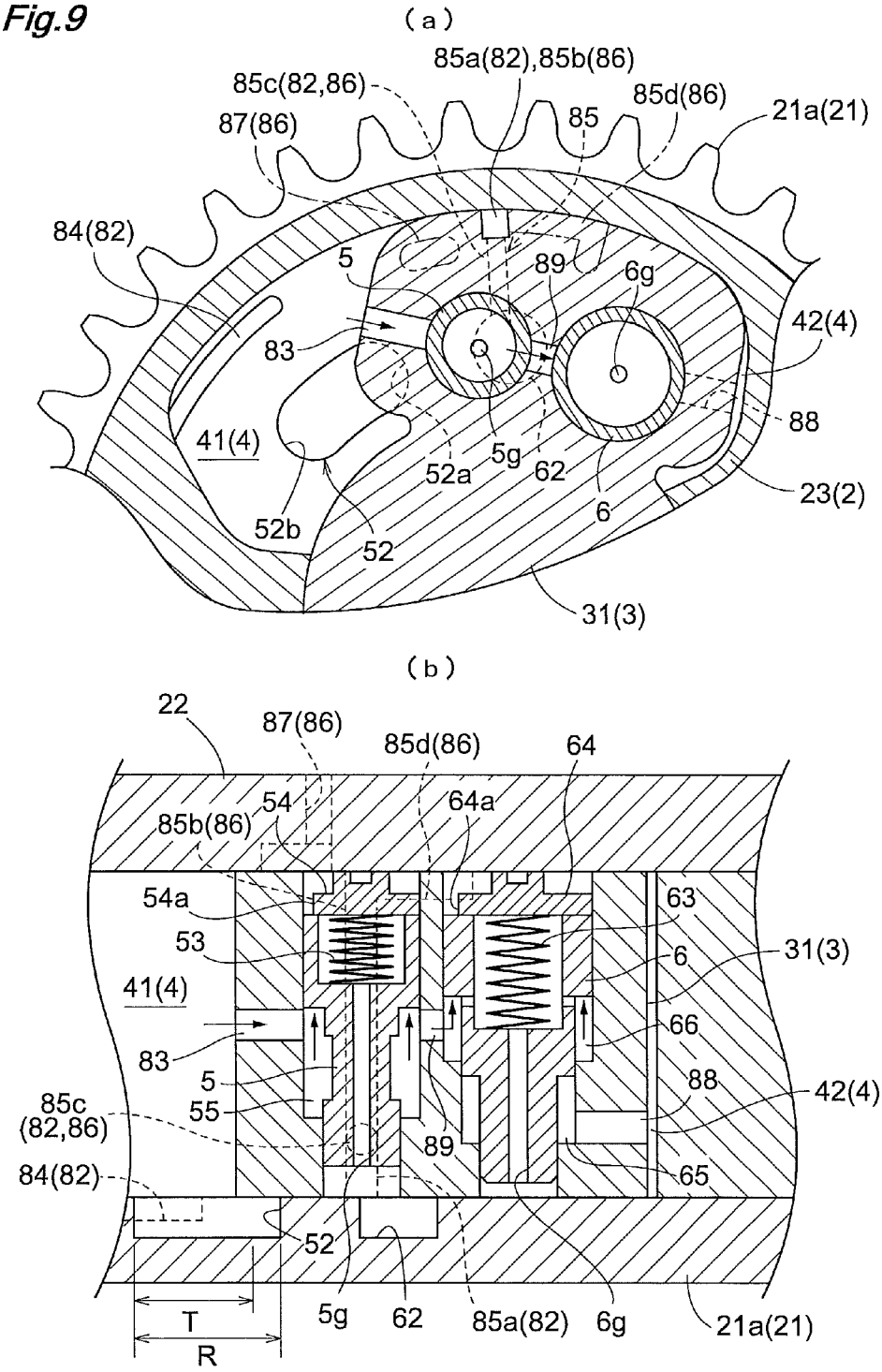
[FIG. 9] are (*a*) a plan view and (*b*) a section view, illustrating conditions of the restricting mechanism and the locking mechanism at the time of angle advancing control under a normal operational condition.

FIG. 9 shows a condition when an angle advancing control has been effected under the normal driving condition. In the case of the angle advancing control, communications are established among the advanced angle chamber 41, the releasing-time communication passageway 83, the first fluid chamber 55, the communication passageway 89 and the third fluid chamber 66, as described hereinbefore. Therefore, an angle advancing operation will be effected with the restriction released state and the lock released state being maintained.

Figure 10:
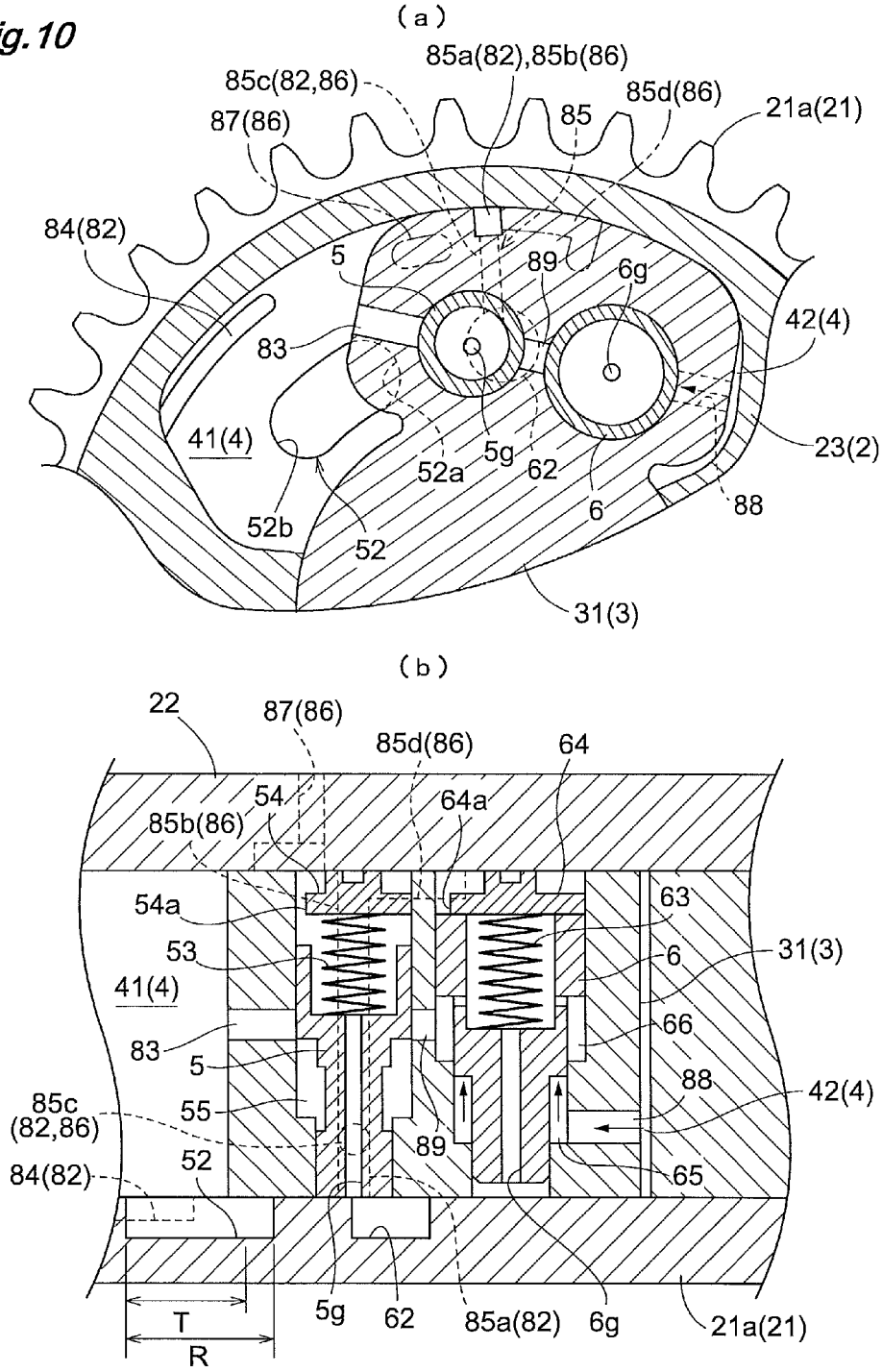
[FIG. 10] are (*a*) a plan view and (*b*) a section view, illustrating conditions of the restricting mechanism and the locking mechanism under the normal operational condition.

FIG. 10 shows a condition when an angle retarding control has been effected under the normal driving condition. Under this condition, as fluid is fed from the retarded angle chamber 42 to the second fluid chamber 65, the lock released state is maintained. On the other hand, as no fluid is fed to the first fluid chamber 55, the restricting member 5 is brought into contact with the rear plate 21 under the urging force of the spring 53. However, as the restricting member 5 slides over the surface of the rear plate 21, the operation will not be hindered. Also, as the restricting recess portion 52 and the locking recess portion 62 are formed at positions mutually offset in the radial direction, the restricting member 5 will not project into the locking recess portion 62.

(Operations at the Time of Restriction and Locking)

Lastly, a procedure of realizing a locked state subsequent to realization of a restricted state will be explained with reference to FIGS. 11 through 13.

Figure 11:
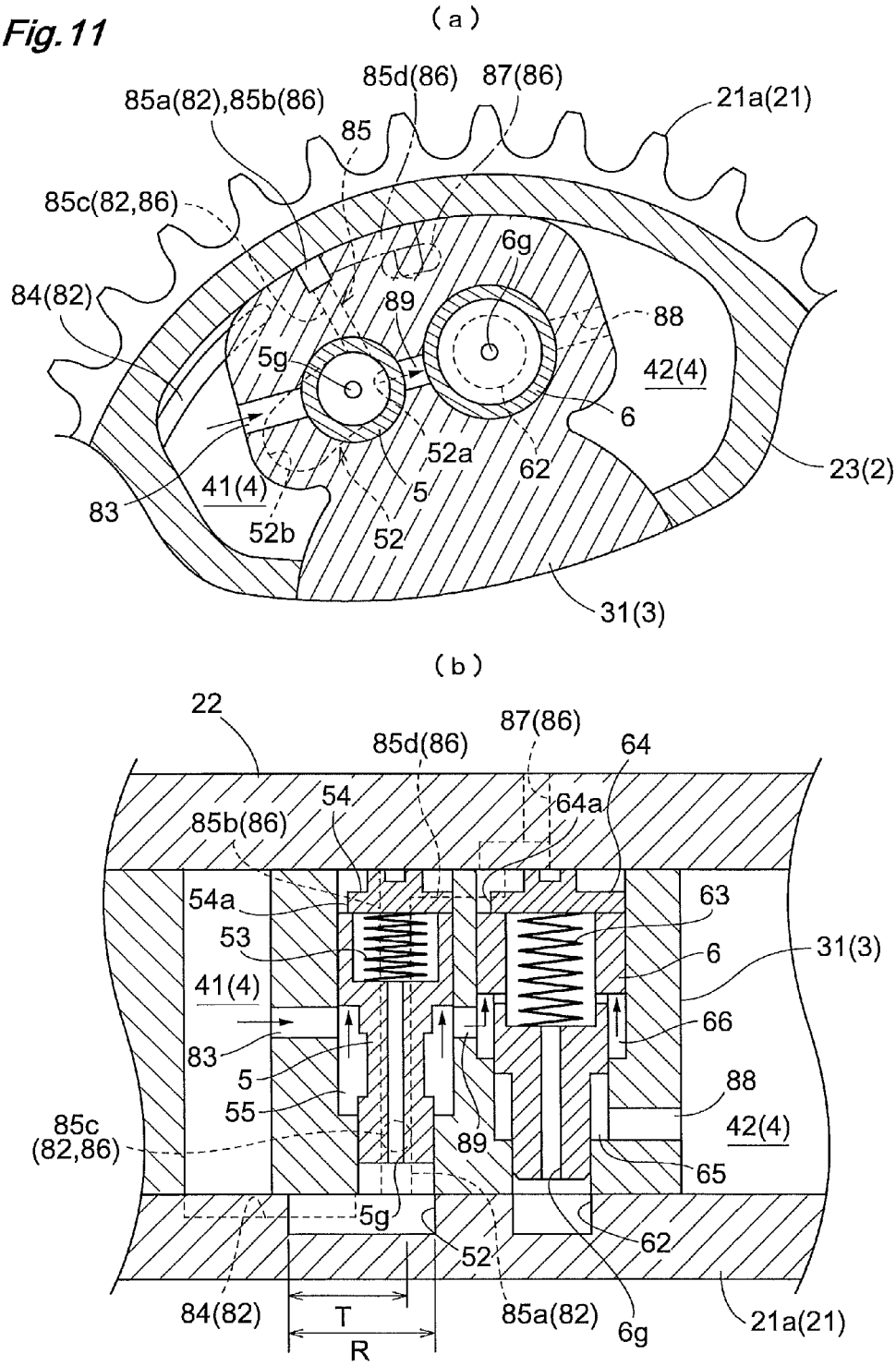
[FIG. 11] are (*a*) a plan view and (*b*) a section view, illustrating conditions of the restricting mechanism and the locking mechanism at the time of start of a locking operation.

FIG. 11 shows a condition when in the angle advancing control, subsequent to establishment of communication between the discharging passageway 85*d* and the discharge hole 87, there has occurred a relative phase rotation to a position at which the drain passageway 86 is operable. Under this condition, as fluid is fed from the advanced angle chamber 41 to the first fluid chamber 55 and the third fluid chamber 66, the restriction released state and the lock released state are maintained ("first state" in the present invention). Due to establishment of communication to the drain passageway 86, when the restricting member 5 is to be projected into the restricting recess portion 52 in the next procedure, the restricted state can be realized speedily by discharge of fluid from the first fluid chamber 55.

Figure 12:
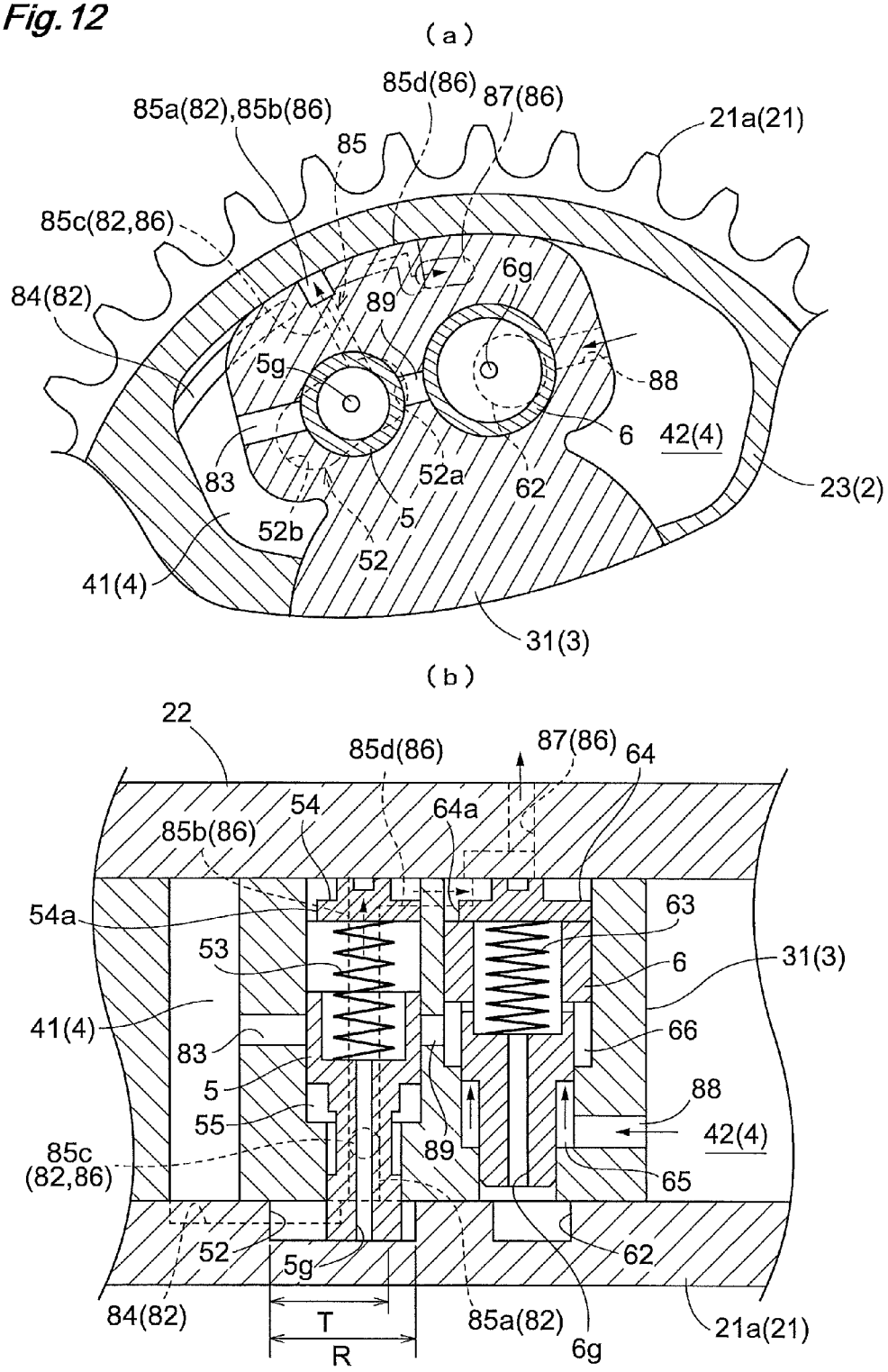
[FIG. 12] are (*a*) a plan view and (*b*) a section view, illustrating conditions of the restricting mechanism and the locking mechanism when a restricted state is to be realized.
Figure 13:
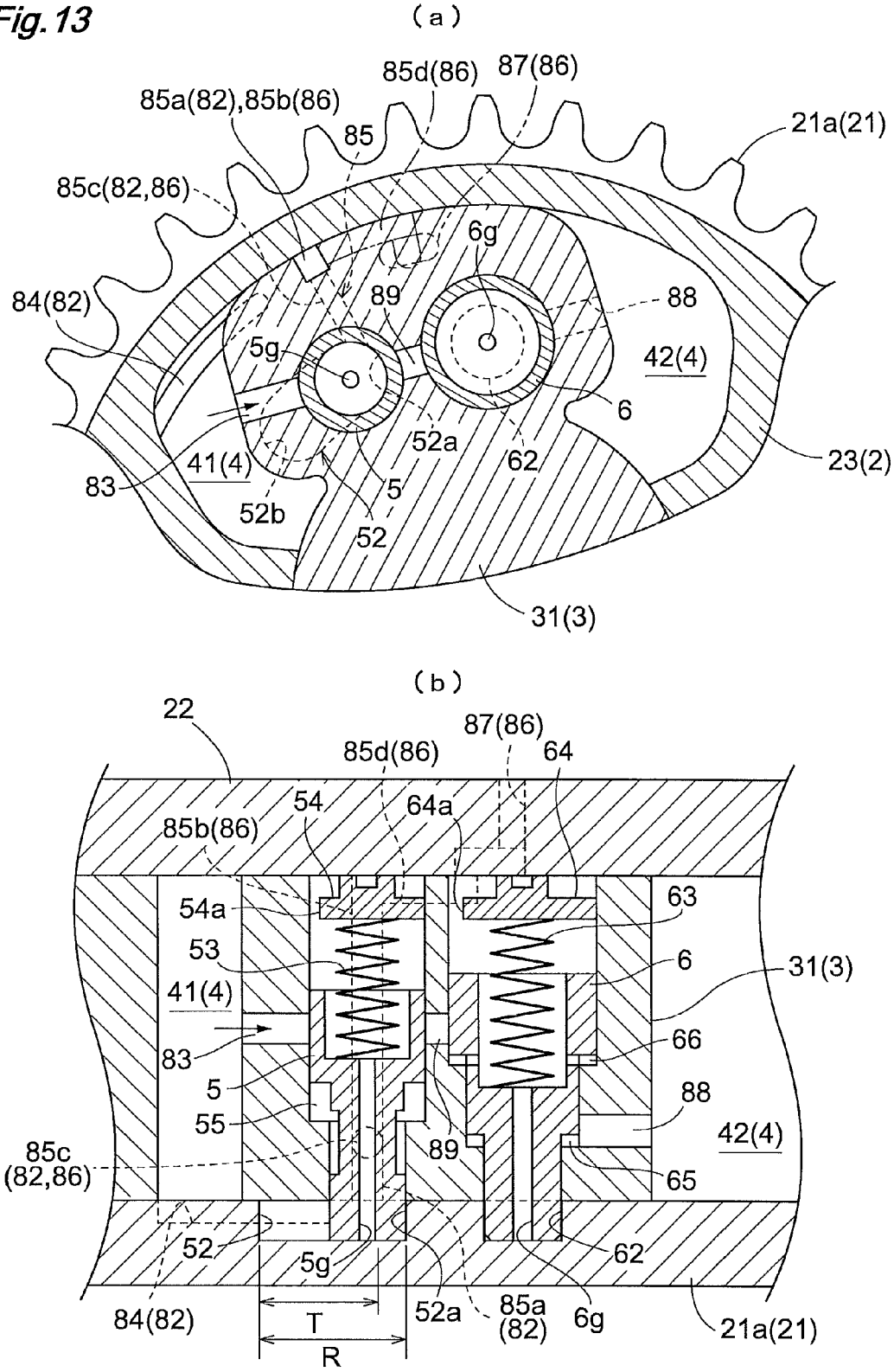
[FIG. 13] are (*a*) a plan view and (*b*) a section view, illustrating conditions of the restricting mechanism and the locking mechanism under the locked state.

FIG. 12 shows a condition wherein a restricted state has been realized with switchover to the angle retarding control ("second state" in the present invention). If the angle retarding control operation is continued after projection of the restricting member 5 into the restricting recess portion 52, due to presence of the restricting member 5 within the restriction releasing possible range T, the restricted state may be released inadvertently at the time of subsequent switchover of control to the angle advancing control. For this reason, after the realization of the restricted state, it is necessary to switch over control to the angle advancing control prior to establishment of communication between the rear plate passageway 84 and the first through passageway 85*a* due to the presence of the restricting member 5 within the restriction releasing possible range T.

With switchover to the angle advancing control prior to entrance of the restricting member 5 into the restriction releasing possible range T, no fluid is fed to the first fluid chamber 55. Hence, the restricting member 5 will not be retracted from the restriction recess portion 52, but will effect an angle advancing movement. As a result, the restricting member 5 will cone into contact with the first end portion 52*a* of the restricting recess portion 52. Here, as the fluid feeding to the communication passageway 89 is stopped, the locking member 6 will be urged by the spring 63 and will project into the locking recess portion 62, whereby the locked state shown in FIG. 13 ("third state" in the present invention) is realized.

As described above, according to the instant embodiment, the first state, the second state and the third state can be switched over each other by the angle advancing/retarding control. Therefore, even in the event of failure of realization of the locked state due to failure of operation of the restricting member 5 or the locking member 6 as expected, the angle advancing/retarding operation can be effected again in order to realize the locked state. Accordingly, the locked state can be realized during an engine operation.

As described above, after realization of the restricted state, the control needs to be switched over to the angle advancing control before communication is established between the rear plate passageway 84 and the first through passageway 85*a* due to the presence of the restricting member 5 within the restriction releasing possible range T. However, for instance, in case the relative rotational phase is detected by means of the angle sensor configured to detect a rotational angle of the unillustrated camshaft 9, an error may occur between the angle detected by the angle sensor and the actual relative rotational phase. Because of this error, in spite of detection by the angle sensor of the restricting member 6 being at a relative rotational phase in a portion of the restricted range R excluding the restriction releasing possible range T, it may sometimes happen that the restricting member 6 has not actually entered the restriction releasing possible range T. In such case, if the control is switched over to the angle advancing control, due to communication between the restriction communicating passageway 82 and the first fluid passageway 55, fluid will be fed to the first fluid chamber 55, thus releasing the restricted state inadvertently.

Figure 14:
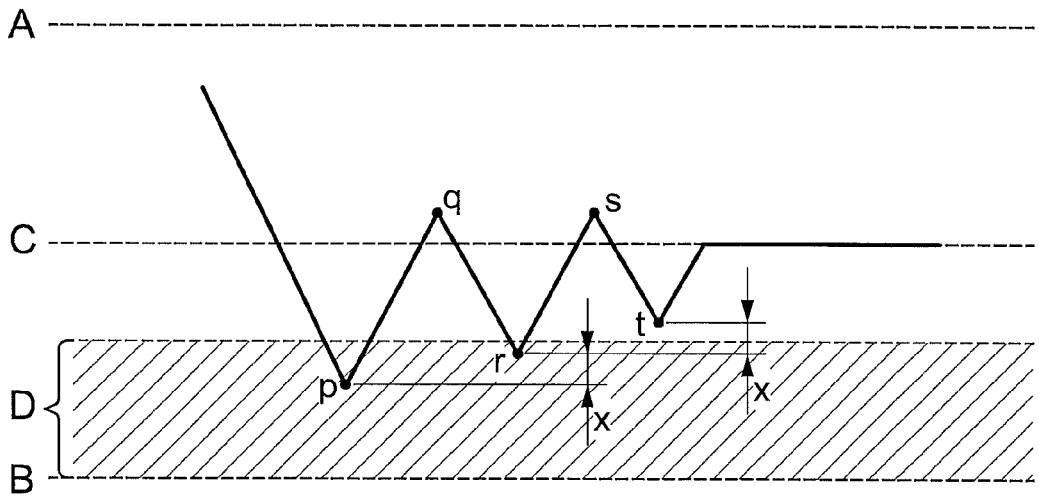
[FIG. 14] is an explanatory view illustrating change of phase at the time of a retrial control.

Next, a retrial control operation effected in this embodiment to solve the above-described problem will be explained with reference to FIG. 14. The mark A in FIG. 14 represents the most advanced angle phase, the mark B represents the most retarded angle phase, the mark C represents the locking phase and the mark D represents a phase range wherein communication is established between the rear plate passageway 84 and the first through passageway 85*a* (to be referred to as "restriction releasing possible phase D" hereinafter). This restriction releasing possible phase D is the phase corresponding to the restriction releasing possible range T.

Also, in case the actual relative rotational phase has reached the restriction releasing possible phase D although the angle sensor detects that it has not yet reached the restriction releasing possible phase D, with switchover to the angle advancing control (point (p)), there occurs a relative rotational movement toward the angle advancing side beyond the locking phase C. Then, the ECU 73 determines this as failure of realization of a locked state and switches the control over to the angle retarding control (point (q)). The next switchover to the angle advancing control (point (r)) will be set more on the locking phase C side by a distance (x) than the point (p). However, as this point (r) too belongs in the restriction releasing possible range D, a locked state cannot be realized, so the control is switched over again to the angle retarding control (point (s)). Subsequently, the control is switched over to the angle advancing control at a phase more on the locking phase side by another distance (x) than the point (r) (point (t)). As this point (t) does not belong in the restriction releasing possible range T, a restricted state can now be realized and a locked state can be realized thereafter.

As described above, by effecting the retrial control operation with shifting the phase for switching to the angle advancing control by the predetermined incremental distance (x) toward the locking phase C side, the locked state can be realized reliably. However, if the error between the angle detected by the angle sensor and the actual relative rotational phase is only a temporary error, the above-described retrial control operation with shifting the phase for switching to the angle advancing control by the predetermined distance (x) toward the locking phase C side need not necessarily be effected. Instead, the phase for switching over to the angle advancing control may be determined based on the detected angle of the angle detecting sensor on each execution of the retrial control operation. Further, the predetermined distance (x) need not always be constant, but can be set to be progressively increased or decreased.

Incidentally, in the layout employed in the above embodiment, the restricting mechanism 50 is disposed on more angle retarding side than the locking mechanism 60. However, the former can be disposed on more angle advancing side than the latter. In such case, with interchanging the languages "angle advancing" and "angle retarding" in the foregoing description, a locked state can be realized prior to engine stop, just like the foregoing embodiment.

Industrial Applicability

The present invention can be applied to a valve timing control apparatus which is configured to realize a locked state before the engine is stopped by controlling a restricting mechanism and a locking mechanism while the engine is operating and which also eliminates the need for a dedicated switching valve for controlling the restricting mechanism and the locking mechanism.

Description of Reference Marks

1 valve timing control apparatus
2 outer rotor (driving-side rotary member)
3 inner rotor (driven-side rotary member)
4 fluid pressure chamber
5 restricting member
6 locking member
31 partitioning portion
41 advanced angle chamber
42 retarded angle chamber
51 restricting member accommodating portion
52 restricting recess portion
53 spring (urging member)
55 first fluid chamber
61 locking member accommodating portion
62 locking recess portion
63 spring (urging member)
65 second fluid chamber
66 third fluid chamber
82 restricting-time communication passageway (restriction releasing passageway)
83 releasing-time communication passageway (restriction releasing passageway)
86 drain passageway
88 lock releasing passageway
89 communication passageway

The invention claimed is:

1. A valve timing control apparatus comprising:

a driving-side rotary member rotated in synchronism with a crankshaft of an internal combustion engine;

a driven-side rotary member disposed coaxially with the driving-side rotary member and rotated in synchronism with a valve opening/closing cam shaft of the internal combustion engine;

a fluid pressure chamber formed by the driving-side rotary member and the driven-side rotary member;

a partitioning section provided in at least one of the driving-side rotary member and the driven-side rotary member for partitioning the fluid pressure chamber into an advanced angle chamber and a retarded angle chamber;

a restricting member disposed in either one rotary member of the driving-side rotary member and the driven-side rotary member and capable of projecting/retracting relative to the other rotary member of the same;

a restricting recess portion formed in the other rotary member for receiving the restricting member projected therein for restricting a relative rotational phase of the driven-side rotary member relative to the driving-side rotary member within a range from either one of a most advanced angle phase and a most retarded angle phase to a predetermined phase between the most advanced angle phase and the most retarded angle phase;

a locking member disposed in said one rotary member provided with said restricting member and capable of projecting/retracting relative to said other rotary member;

a locking recess portion formed in said other rotary member for receiving the locking member projected therein for locking the relative rotational phase of the driven-side rotary member to the driving-side rotary member to said predetermined phase;

a communication passageway capable of feeding fluid releasing the restriction by the restricting member to the locking member and incapable of feeding fluid releasing the locking by the locking member to the restricting member; and said restricting member switching over said communication passageway to a communicating state or to a non-communicating state.

2. The valve timing control apparatus according to claim 1, wherein the apparatus is capable of selectively providing a first state wherein the restriction by the restricting member is released and the locking by the locking member is released and a second state wherein the locking by the locking member is released and the restriction is provided by the restricting member, the first state and the second state both being provided with the communication passageway being set at the communicating state, and a third state wherein the restriction by the restricting member is provided and the locking by the locking member is provided, the third state being provided with the communication passageway being set at the non-communicating state.

3. The valve timing control apparatus according to claim 2, wherein transition from the third state to the second state is effected by feeding fluid to either one of the advanced angle chamber and the retarded angle chamber and the transition from the second state to the first state is effected by feeding fluid to the other of the advanced angle chamber and the retarded angle chamber.

4. The valve timing control apparatus according to claim 2, wherein the apparatus further comprises a fluid controlling means that can be switched over to the first state, the second state or the third state, and wherein said fluid controlling means includes:

a restricting member accommodating portion having a first fluid chamber for receiving the fluid for releasing the restriction by the restricting member, said restricting member accommodating portion being formed in said one rotary member for accommodating the restricting member, a locking member accommodating portion having a second fluid chamber for receiving the fluid for releasing the locking of the locking member and a third fluid chamber provided separately from said second fluid chamber for receiving the fluid for retaining the lock-released locking member under this lock-released state, said locking member accommodating portion being formed in said one rotary member for accommodating said locking member, a restriction releasing passageway for establishing communication between one of said advanced angle chamber and said retarded angle chamber and said first fluid chamber, a lock releasing passageway for establishing communication between the other of said advanced angle chamber and said retarded angle chamber and said second fluid chamber; and said communication passageway configured to establish communication between said first fluid chamber and said third fluid chamber;

wherein said fluid controlling means selectively provides said first state by feeding fluid to said first fluid chamber, said communication passageway, said third passageway via said restriction releasing passageway, said fluid controlling means selectively provides said second state by feeding fluid to said second fluid chamber via said lock releasing passageway, and said fluid controlling means selectively provides said third state by feeding fluid to none of said first fluid chamber, said second chamber and said third chamber.

5. The valve timing control apparatus according to claim 4, wherein said restriction releasing passageway includes:

a restricting-time communication passageway capable of establishing communication between either one of the advanced angle chamber and the retarded angle chamber and the first fluid chamber when the restricting member is projected into the restricting recess portion, and a releasing-time communication passageway capable of establishing communication between either one of the advanced angle chamber and the retarded angle chamber and the first fluid chamber when the restricting member is retracted away from the restricting recess portion.

6. The valve timing control apparatus according to claim 5, wherein said restricting-time communication passageway is configured to provide non-communication between one of said advanced angle chamber and said retarded angle chamber and said first fluid chamber when the driving-side rotary member and the driven-side rotary member are located within a preset phase toward one of said most advanced angle phase and said most retarded angle phase from the condition of the driving-side rotary member and the driven-side rotary member being at said predetermined phase, when said restricting member moves within the range from either one of the most advanced angle phase and the most retarded angle phase to said predetermined phase.

7. The valve timing control apparatus according to claim 4, wherein there is provided an angle sensor for detecting a rotational angle of said camshaft;

said angle sensor being configured to detect establishment of a relative rotational phase where either one of the advanced angle chamber and the retarded angle chamber is communicated with the first fluid chamber via the restriction releasing passageway; and after continuation of a relative rotational movement at the time of said detection for a predetermined period, the direction of the relative rotational movement is switched over to shift from the second state to the first state.

8. The valve timing control apparatus according to claim 2, wherein the apparatus is configured to effect a retrial control wherein when the restricting member is located at a relative rotational phase where the restricting member can project into the restricting recess portion, the direction of the relative rotational movement is switched over to shift to the second state and thereafter, when the restricting member has moved to a relative rotational movement to outside of the relative rotational phase where the restricting member can project into the restricting recess portion, the direction of the relative rotational movement is first reverted and then switched over after the restricting member has moved to the relative rotational phase where the restricting member can project into the restricting recess portion.

9. The valve timing control apparatus according to claim 8, wherein the relative rotational phase where the direction of the relative rotational movement is switched over at the time of the retrial control is set as a phase that differs by a predetermined distance on the side of said predetermined phase than a relative rotational phase where the direction of the relative rotational movement was switched over immediately before.

10. The valve timing control apparatus according to claim 1, wherein there is provided a drain passageway which becomes communicated with the first fluid chamber for discharging to the atmosphere when either one of the advanced angle chamber and the retarded angle chamber is not communicated with the first fluid chamber when the restricting member is moved within the range from one of the most advanced angle phase and the most retarded angle phase to said predetermined phase or when said locking member is under the locking state.

11. The valve timing control apparatus according to claim 1, wherein said fluid feeding controlling means is configured to shift said restricting member and said locking member to the first state, the second state and the third state one after another, when the rotational speed of the internal combustion engine becomes a value lower than a preset value.

12. The valve timing control apparatus according to claim 1, wherein said restricting member and said locking member are respectively provided with an urging member for urging said restricting member or said locking member toward the restricting recess portion or toward the locking recess portion.

* * * * *